US008292376B1

(12) United States Patent
Stelmasik

(10) Patent No.: US 8,292,376 B1
(45) Date of Patent: Oct. 23, 2012

(54) ADJUSTABLE PIVOT ASSIST MECHANISM FOR AN ENCLOSURE DOOR OF A DISPLAY CASE

(76) Inventor: Gregory A. Stelmasik, Brooklyn Park, MN (US)

( * ) Notice: Subject to any disclaimer, the term of this patent is extended or adjusted under 35 U.S.C. 154(b) by 324 days.

(21) Appl. No.: 12/694,963

(22) Filed: Jan. 27, 2010

(51) Int. Cl.
*A47F 3/00* (2006.01)

(52) U.S. Cl. ..... 312/139; 49/386

(58) Field of Classification Search ..... 49/386, 49/387; 312/138.1, 139 X, 319.2, 327, 328
See application file for complete search history.

(56) References Cited

U.S. PATENT DOCUMENTS

| | | | | |
|---|---|---|---|---|
| 4,383,347 | A * | 5/1983 | La Conte | 16/360 |
| 4,452,015 | A * | 6/1984 | Jacques et al. | 49/386 |
| 4,788,747 | A | 12/1988 | Ludwig | |
| 4,842,349 | A | 6/1989 | Stenemann | |
| 4,854,554 | A | 8/1989 | Ludwig | |
| 5,112,118 | A | 5/1992 | Wiehle | |
| 5,116,274 | A | 5/1992 | Artwohl et al. | |
| 5,207,490 | A | 5/1993 | Kaspar et al. | |
| 5,618,089 | A | 4/1997 | Stenemann | |
| 5,622,414 | A | 4/1997 | Artwohl et al. | |
| 5,639,149 | A * | 6/1997 | Grassmuck | 312/116 |
| 6,547,346 | B2 | 4/2003 | Topper et al. | |
| 6,634,460 | B1 * | 10/2003 | Hackenberg | 186/59 |
| 7,293,819 | B2 * | 11/2007 | Duffy | 296/76 |
| 7,877,931 | B2 * | 2/2011 | Cianetti | 49/339 |

FOREIGN PATENT DOCUMENTS

| | | |
|---|---|---|
| CA | 2141264 | 4/2005 |
| DE | 3901831 A1 * | 7/1990 |

* cited by examiner

*Primary Examiner* — Jerry Redman

(57) ABSTRACT

A system having an adjustable pivot length assist mechanism for a cover or door of an enclosure. Adjusting lengths of a link may change a differential ratio of mechanical advantage in that a small change in the force transfer link length yields a large change in the gas spring load for a given force at the other end of the link. The mechanism may utilize one or more gas springs. One end of a spring may be connected to a bellcrank rotatable on a shaft attached to a portion of a hinge secured to the enclosure. Another portion of the hinge may be attached to and support the door relative to the enclosure. Attached to another location on the bellcrank may be a force transfer link connected to a lever attached to a door portion of the hinge. The force transfer link may have a length adjustment. At least one end of each of the one or more gas springs may have two-dimensional movement.

20 Claims, 29 Drawing Sheets

59

Table
Geometry Relationships (Panel Down)

| | Link Length 51 | Link Angle 52 | Link Distance 53 | Spring Distance 54 | Spring Length 55 | Support Force (N) |
|---|---|---|---|---|---|---|
| Figure 22 | 3.124" | 16.2° | 1.512" | 1.023" | 6.645" | 622 |
| Delta | 0.050" | 1.1° | 0.026" | 0.075" | 0.031" | 53 |
| Figure 23 | 3.174" | 17.3° | 1.486" | 0.948" | 6.612" | 675 |
| Delta | 0.050" | 1.1° | 0.026" | 0.078" | 0.034" | 100 |
| Figure 24 | 3.224" | 18.4° | 1.460" | 0.870" | 6.581" | 775 |
| \|ΔDelta\| | 0.000" | 0.0° | 0.00" | 0.003" | 0.003" | 47 |

*Figure 25*

ADJUSTABLE PIVOT ASSIST MECHANISM FOR AN ENCLOSURE DOOR OF A DISPLAY CASE

BACKGROUND

The present system pertains to enclosures and particularly to doors for enclosures. More particularly, the system pertains to support mechanisms for the doors of an enclosure.

SUMMARY

The present system may have an adjustable pivot assist mechanism for a door, sheet, panel or cover of a refrigerated, heated, or temperature or non-temperature controlled enclosure which may be used for merchandise display or storage, or other purposes. The mechanism may utilize the assistance of one or more gas springs, energy accumulators or force translation devices (e.g., pneumatic springs, or the like). The motion of one or more ends of each, for example, gas spring may be just two-dimensional. One end of a gas spring may be connected at a location on a bellcrank rotatable on a shaft attached to a base portion of a hinge secured to the enclosure. The other portion of the hinge may be attached to and support the door about a hinge axis relative to the enclosure. Attached to another location on the bellcrank may be one end of a force transfer link. The other end of the link may be connected to a lever attached to a door portion of the hinge. The force transfer link may have a length adjustment. A change in the length adjustment of the force transfer link may change a differential ratio of mechanical advantage in that a small change in the force transfer link length yields a large change in the gas spring load for a given force at an end of the force transfer link. There may be a hole in the bellcrank and a hole in the base portion of a hinge secured to the enclosure for a pin to hold the bellcrank in place relative to the base portion for changing or maintaining the gas spring or performing other maintenance.

BRIEF DESCRIPTION OF THE DRAWING

FIG. 25 is a table of data measured for several length settings of the force transfer link in FIGS. 22, 23 and 24.

DESCRIPTION

Figure 1:
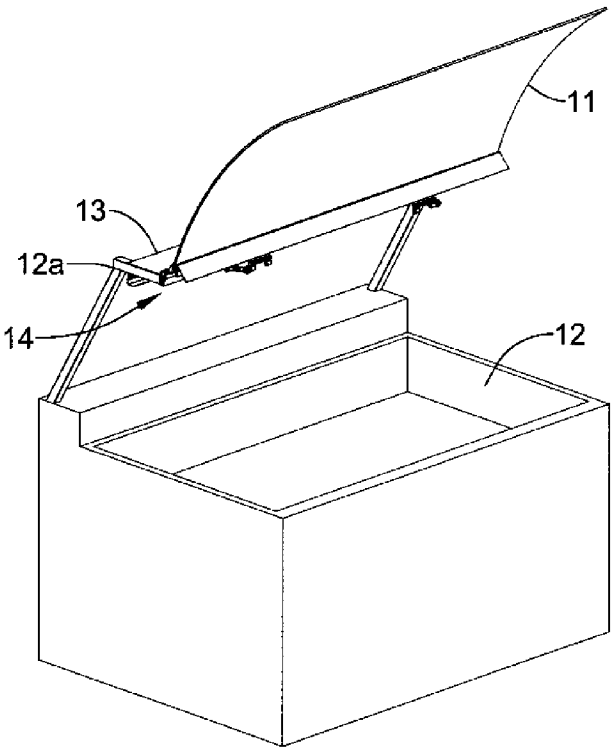
FIGS. 1 and 1A are diagrams of an illustrative example door for an enclosure using an adjustable pivot assist mounting mechanism for the door.
Figure 1A:
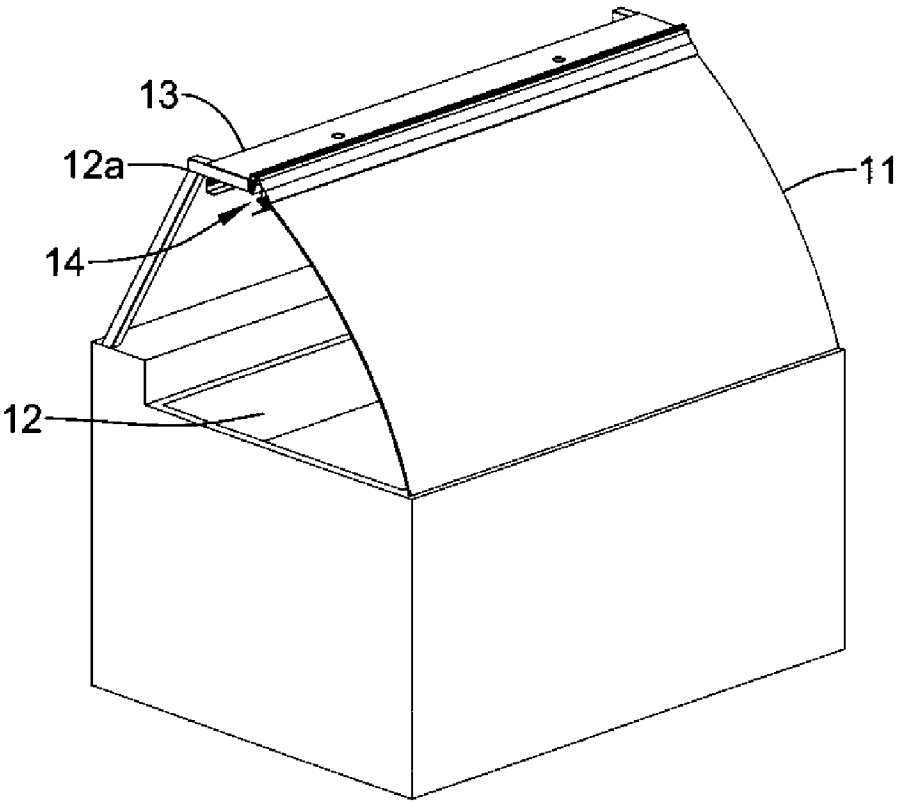

The present system includes an adjustable pivot assist mechanism for a sheet, panel, cover or door of perhaps an enclosure for refrigeration, merchandise, and the like. The terms sheet, panel, cover and door may be substituted for each other in the present specification. Other equivalent terms may be used. FIGS. 1 and 1A are diagrams of a door 11 in open and closed positions, respectively, for an enclosure 12 for which the example adjustable pivot assist mechanism 13 may be illustrated. The panel or door 11 may be transparent in cases where there are contents which are intended to be showcased. The door 11 may be opened by lifting the bottom part of the door at its lower ledge or by a handle near the edge. The door may be glass, plastic or some other material, whether transparent, translucent or opaque. Door 11 may have various shapes and profiles. The Figures merely provide an illustrative example of a door. Door 11 may be supported by a hinge arrangement 14 attached to enclosure 12. The hinge arrangement 14 may be supported with mounts 12A other than the enclosure 12.

Figure 2:
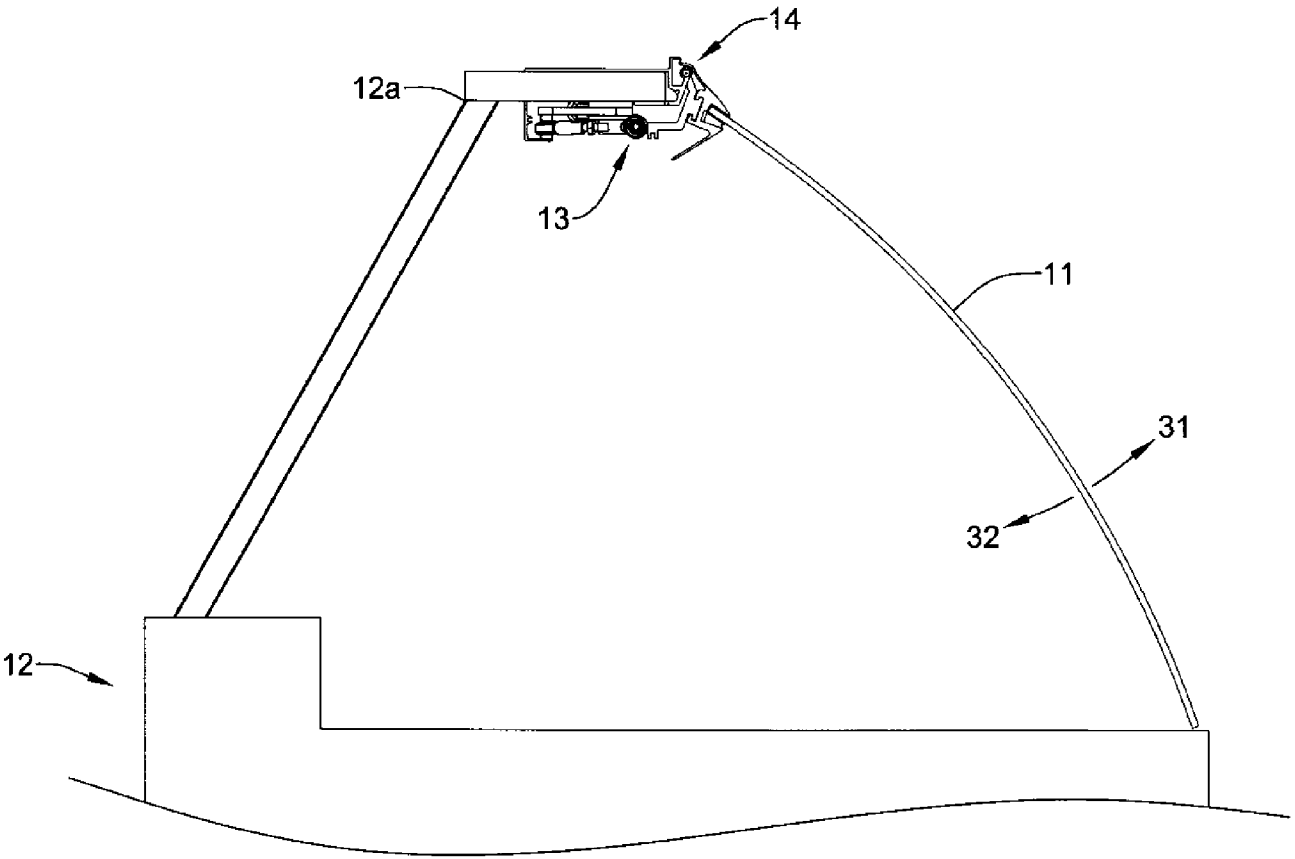
FIG. 2 is a diagram of a side view of the door and pivot assist mechanism which is connected to a hinge arrangement between the door and the enclosure.
Figure 2A:
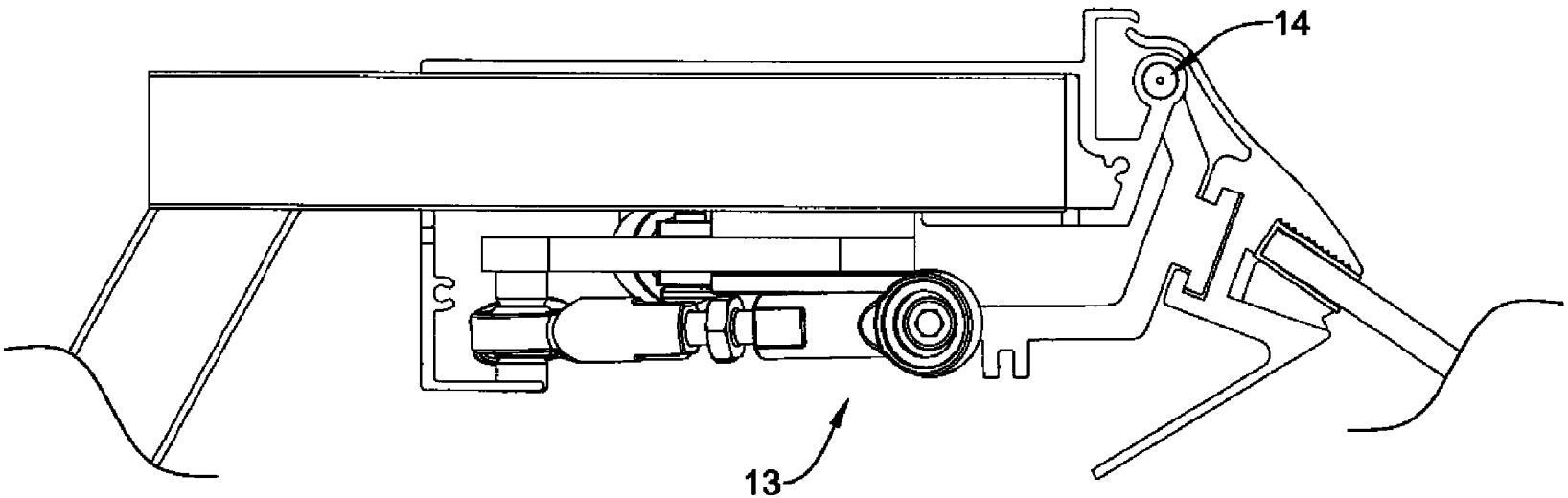
FIG. 2A is a diagram which zooms in on an adjustable pivot assist mechanism shown in FIG. 2.

FIG. 2 is a diagram of a side view of door 11 and a pivot assist mechanism 13 which may be connected to hinge arrangement 14 that holds door 11 relative to enclosure 12. Arrangement 14 may provide a mount for assist mechanism 13 which is a mechanical connection between enclosure 12 and door 11. FIG. 2A is a zoomed-in view of mechanism 13.

Figure 3:
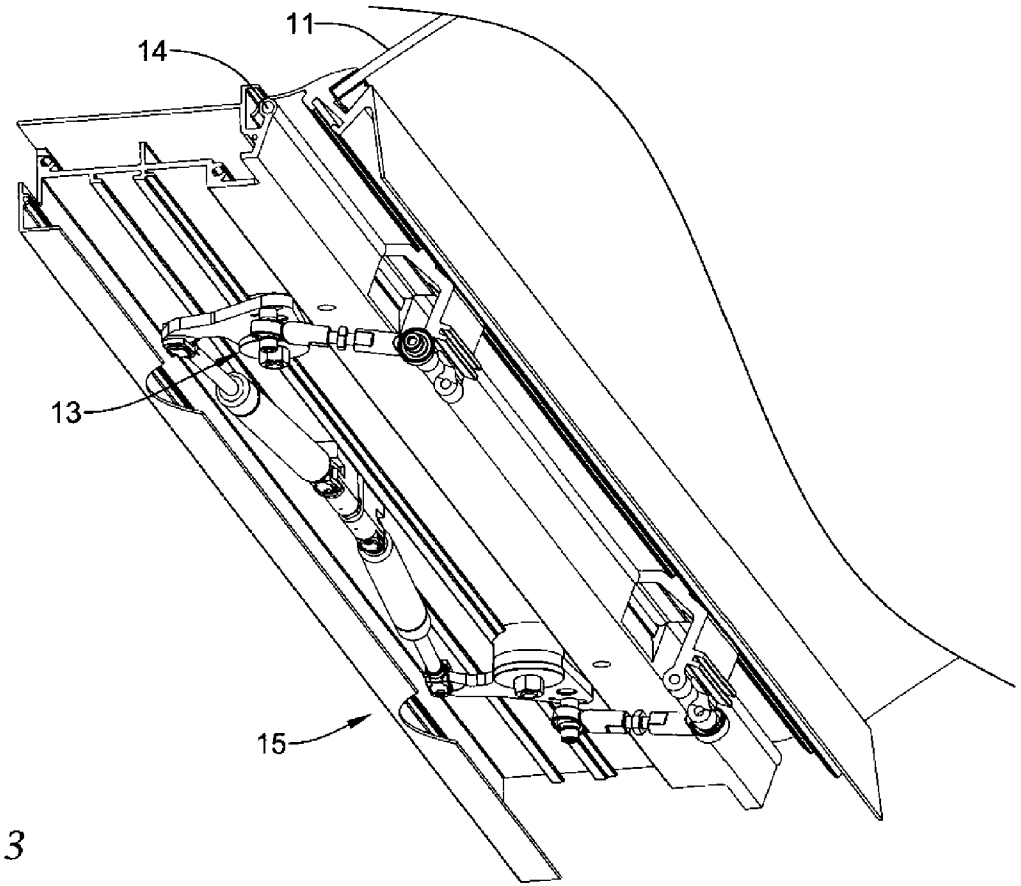
FIG. 3 is a diagram of a bottom-side view of the hinge arrangement between the door and the pivot assist mechanism.
Figure 4:
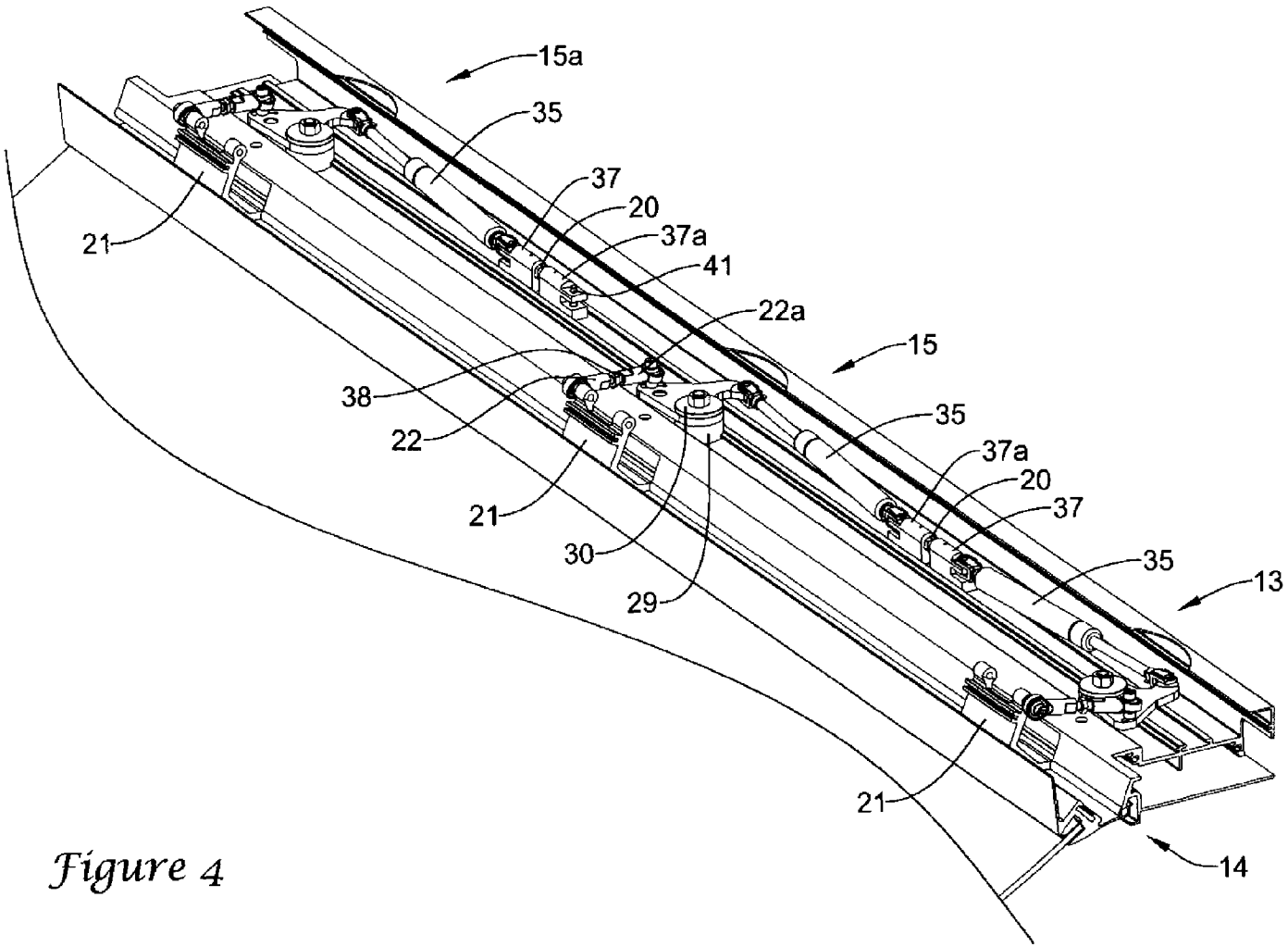
FIG. 4 is a diagram like that of FIG. 3 except that another pivot assist mechanism is attached to hinge arrangement.
Figure 5:
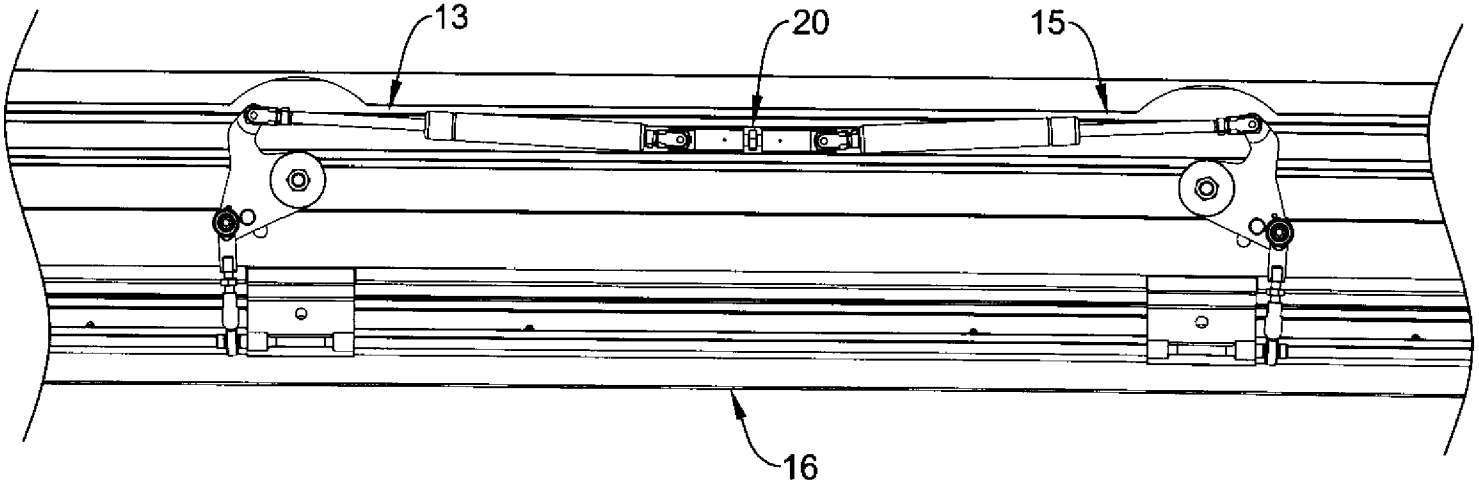
FIG. 5 is a diagram like that of FIG. 4 except the orientation of pivot assist mechanism is different than mechanism of FIG. 4, and has a service adjustment design.

FIG. 3 is a diagram of a bottom-side view of the hinge arrangement 14 with the door 11 and the assist mechanism 13 and assist mechanism 15. FIG. 4 is a diagram like that of FIG. 3 except that another pivot assist mechanism 15A may be attached to hinge arrangement 14. Door 11 in FIG. 4 may be larger and/or heavier than door 11 in FIG. 3, thus requiring either a larger pivot assist mechanism 13 and 15 or an additional assist mechanism 15A. Assist mechanisms 13/15 and 15A are not necessarily connected to each other. One or more additional assist mechanisms may be installed as indicated on hinge arrangement 14. FIG. 5 is a diagram like that of FIG. 4 except the orientation of pivot assist mechanism 15 may be different than that of mechanism 13 of FIG. 4. Mechanisms 13 and 15 in FIG. 5 may be connected to each other by adjustable connection 20 but not fixed to base 16 of hinge 14. One or more additional pivot assist mechanisms of various or the same orientations may be installed on hinge arrangement 14. There may be a multitude of doors on enclosure 12, each having one or more pivot assist mechanisms. Generally, there may be one or more doors, each having at least two pivot assist mechanisms.

Figure 6:
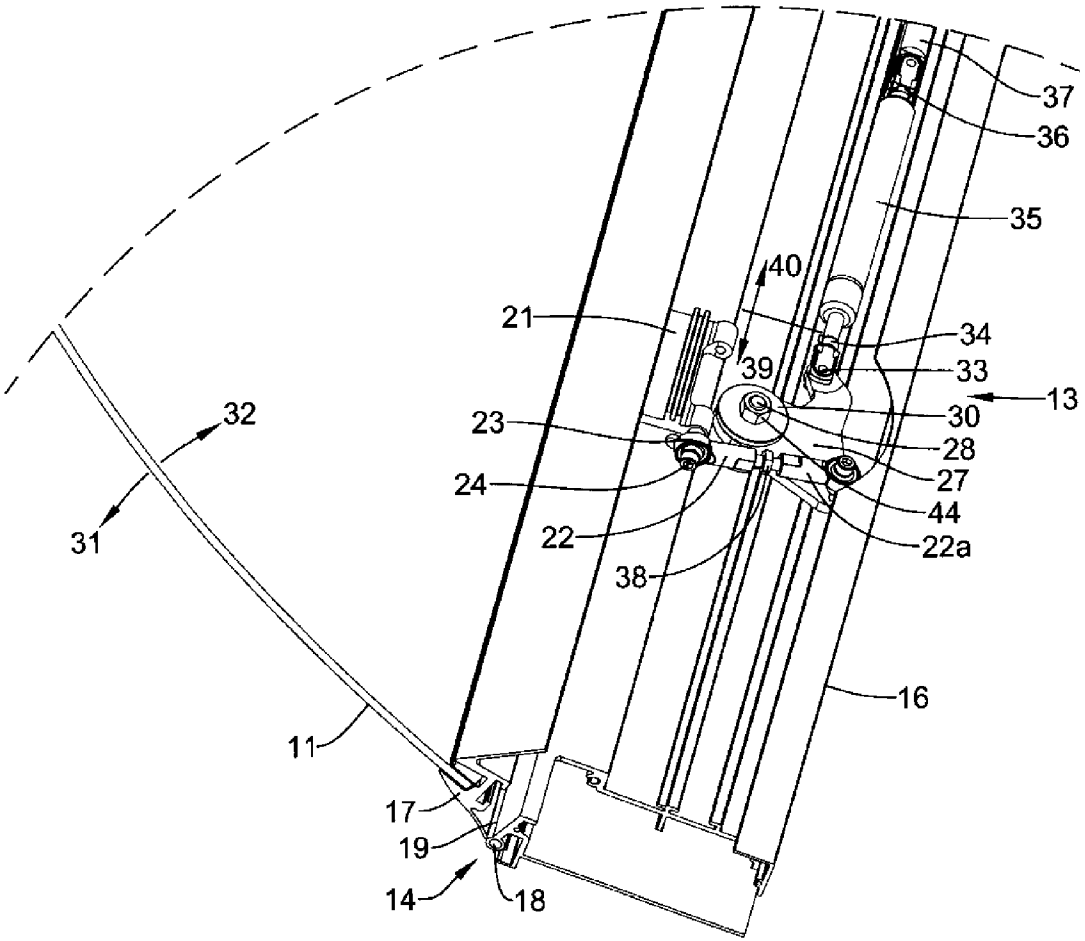
FIG. 6 is a diagram showing a closer view of the pivot assist mechanism.
Figure 6A:
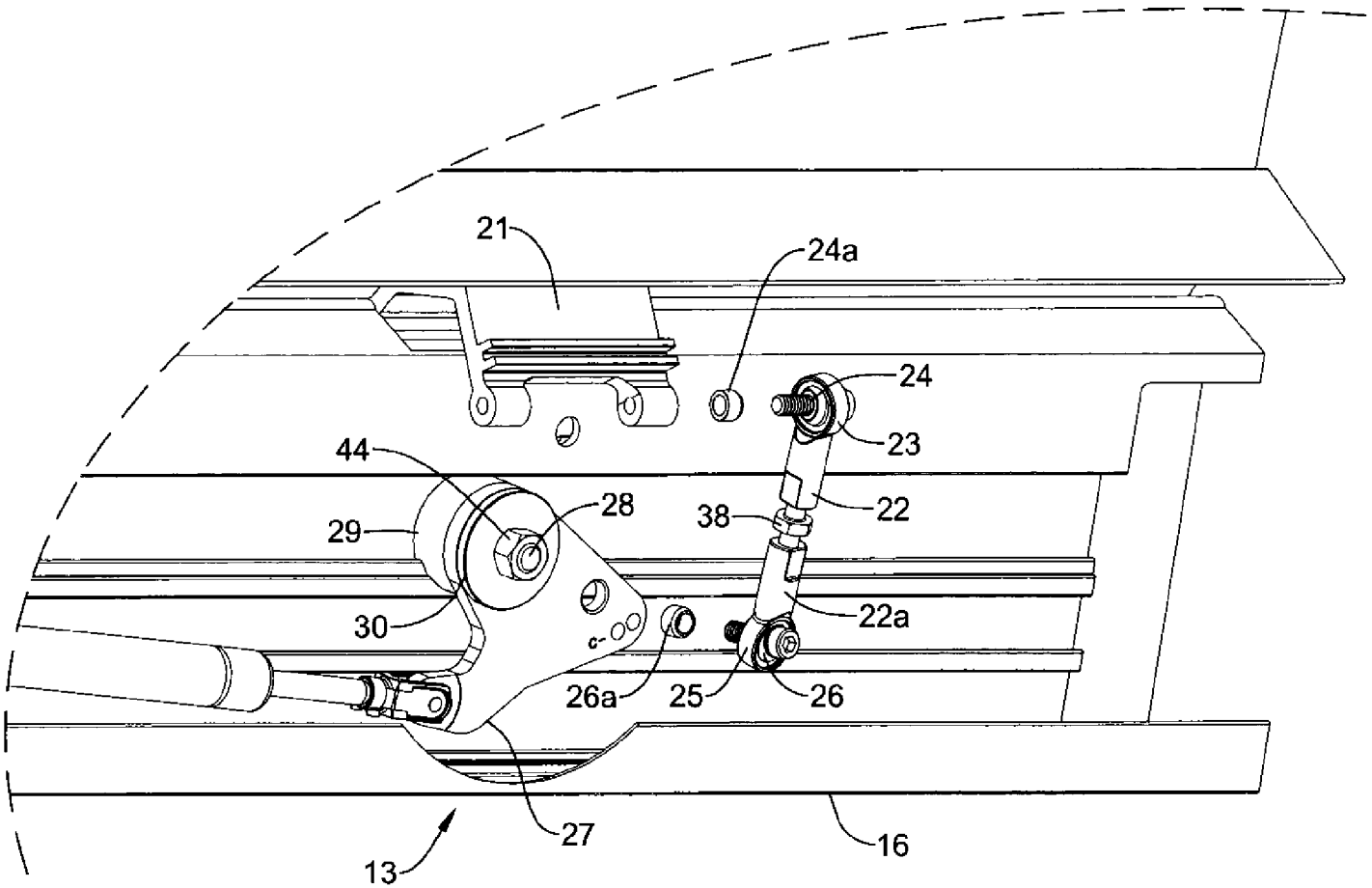
FIG. 6A is an exploded view of the pivot assist mechanism.

FIG. 6 and FIG. 6A are diagrams showing a closer view of the pivot assist mechanism 13. FIG. 6A is an exploded view to show assembly detail. Other assist mechanisms such as mechanism 15 may be the same as mechanism 13. Hinge arrangement 14 may include a base 16 attached to enclosure 12 as shown in FIGS. 1 and 1A and a hinge 17 which is attached to and holds door 11. Hinge 17 may rotate about an axis which is aligned to a pin 18 which holds hinge 17 to a hinge 19 which is attached to base 16, much like a conventional swinging door to a room in a house. Often such hinge arrangement may be referred to as a "butt hinge" or other label descriptive of hinge assembly 14. Attached to hinge 17 that holds door 11 may be a lever 21. As door 11 moves, lever 21 may move along with door 11. Moving lever 21 relative to base 16 may move door 11 in the same manner relative to base 16. Connected to lever 21 may be a rod or ball link 22, such as an adjustable force transfer link, which can move lever 21. Ball link 22 may be connected with a moveable pivot 23 attached (as a note, 22 and 23 are one complete unit and are threaded with a LH or RH internal thread that "jack screw" 38 uses to change the distance between link 22 and link 22A to a protrusion 24 on lever 21. The other end of rod or link 22A may be connected with a moveable pivot 25 to a protrusion 26 on plate or bellcrank 27. Protrusions 24 and 26 may include a threaded fastener and stand-off 24A and 26A for connection, and positioning. Plate or bellcrank 27 may have a hole in it which fits on a support mount bellcrank bearing 29 and short shaft 28 attached to base 16. Bellcrank 27 may rotate about an axis of shaft 28 and bellcrank bearing 29. A fastener 44 (FIG. 16), such as a nut screwed on a threaded portion of shaft 28, and positioned between bellcrank bearing 29 and bellcrank washer 30, may serve to keep bellcrank 27 from slipping off of shaft 28. If bellcrank 27 rotates clockwise looking toward and in a direction parallel to the axis of shaft 28 on the bellcrank 27 side of base 16, link 22 and link 22A may move towards hinge connection pin 18 and push lever 21 which moves door 11 in a direction 31 so as to open or further open door 11. If bellcrank 27 rotates counter-clockwise, then link 22 and 22A may move away from hinge connection pin 18 and pull lever 21 which moves door 11 in a direction 32 so as to close or further close door 11.

Figure 10:
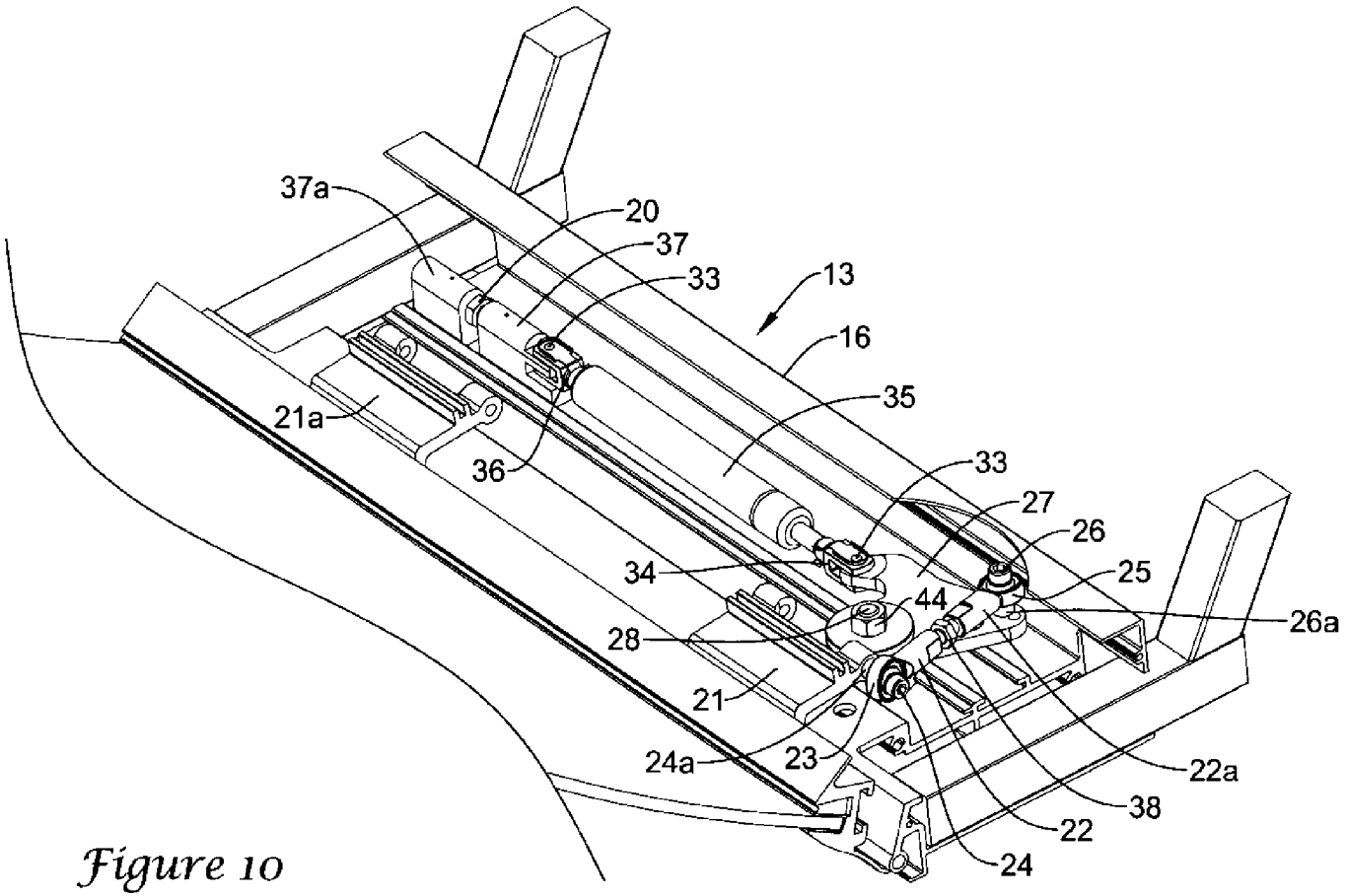
FIG. 10 shows the arrangement of the door lift system where the gas spring or energy accumulator is revealed, including an end which is connected to a protrusion or mount attached to a base.

Attached to a protrusion or hole on bellcrank 27 may be a connection 33 to an end 34 of a gas spring or energy accumulator 35. Another end 36 of spring 35 may be connected to a protrusion or mount 37 attached to base 16 of hinge arrangement 14 (FIG. 10). Mount 37 may be moved along a length relative to 37A, both positioned in a channel on base 16 thereby permitting adjustment of the position of end 36 of gas spring 35. Adjustment is accomplished using "Jack Screw" 20 between 37 and 37A. The length between link 22 and 22A between pivots 23 and 25 may be adjusted by turning a hex nut feature of "jack screw" 38 on a threaded shaft in links 22 and 22A. Item 38 may be regarded as a "jack screw" which is a term of art. Other approaches may be utilized to adjust the relative length between link 22 and 22A. Energy accumulator or gas spring 35 may exert force on bellcrank 27 via connection 33 at the protrusion or hole in a direction 39 (FIG. 6). The force in direction 39 will tend to rotate bellcrank 27 clockwise which in turn may cause link 22 and link 22A to apply force on lever 21 thereby causing door 11 to be pushed in direction 31. A force opposite to the pushing of the door 11 in direction 31 may be a weight of door 11 pushing the door in the opposite direction 32 towards closure. With an appropriate adjustment of link 22 and link 22A, the pressure or force 39 or force in direction 39 on the bellcrank 27 at the protrusion or hole with connection 33 from end 34 of spring 35, may balance the weight of door 11 which may be easy to lift and open, and once it is open, it can stay open without a lifting force external to the lift system. Also, this adjustment may allow door 11 to be closed easily and softly without the door falling and closing abruptly.

The lift system for door 11 of enclosure 12 may be seen from the side, as shown by FIG. 2, which indicates the cross-sectional geometry. Door 11 may stay down or closed for the present explanation to show the starting position and the closing load change at this position. By changing the relative length between link 22 and link 22A, the effective load requirement may be changed, as described herein.

The glass weight, assuming door 11 in this example to be made of glass, and the distance to the center of mass of door 11 may establish a load for the lift system. By changing the length of the bellcrank or force transfer link 22 and 22A, the resultant force 40 or force in direction 40 to gas spring 35 may change based on a combination of geometry and size relationships among the components of the lift system. The geometric relationships may be chosen to provide a differential ratio of mechanical advantage. In effect, a small change in the length between link 22 and link 22A using jack screw 38 may yield a large spring 35 load requirement change, i.e., force 40. In other words, adjusting the length of the force transfer link 22 and 22A using jack screw 38 may change a differential ratio of mechanical advantage in that a small change in the force transfer length between link 22 and link 22A yields a large change in the gas spring 35 load requirement for a given load at the second end of the force transfer link 22.

Figure 7:
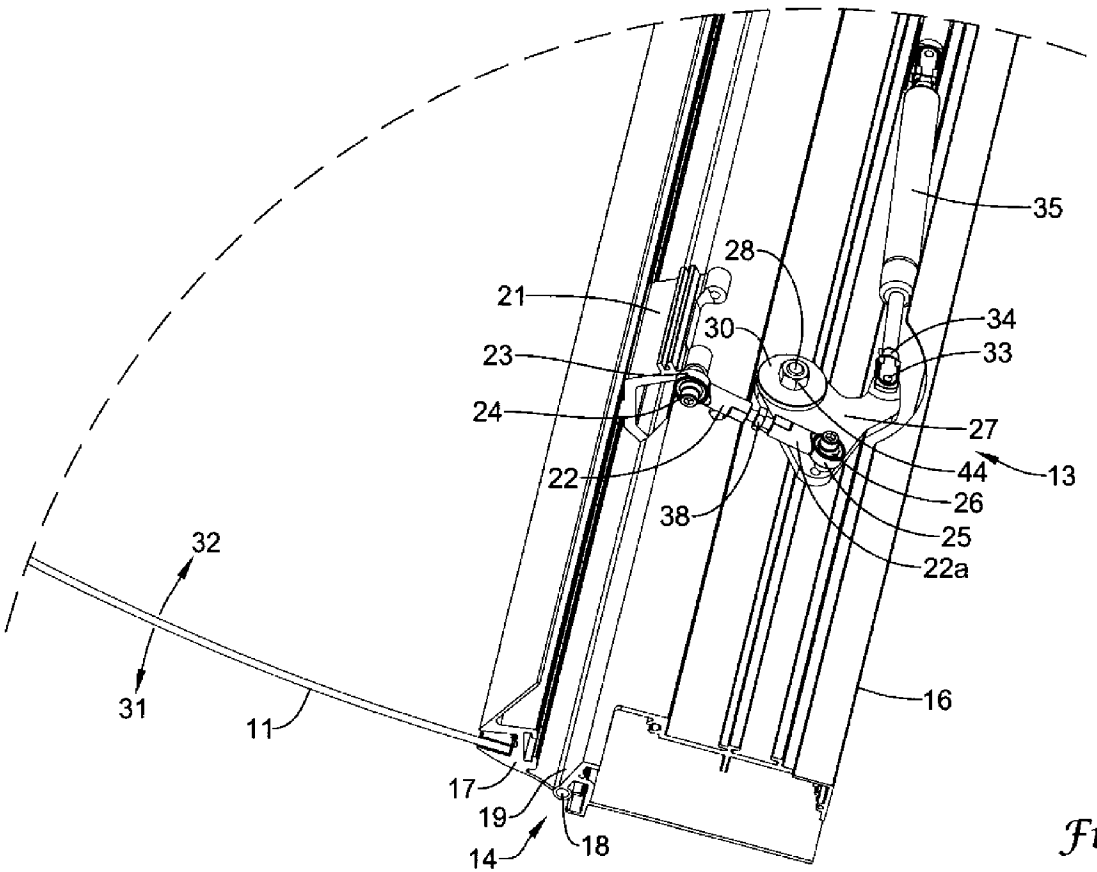
FIG. 7 is a diagram showing one position of moving components of the pivot assist mechanism.
Figure 8:
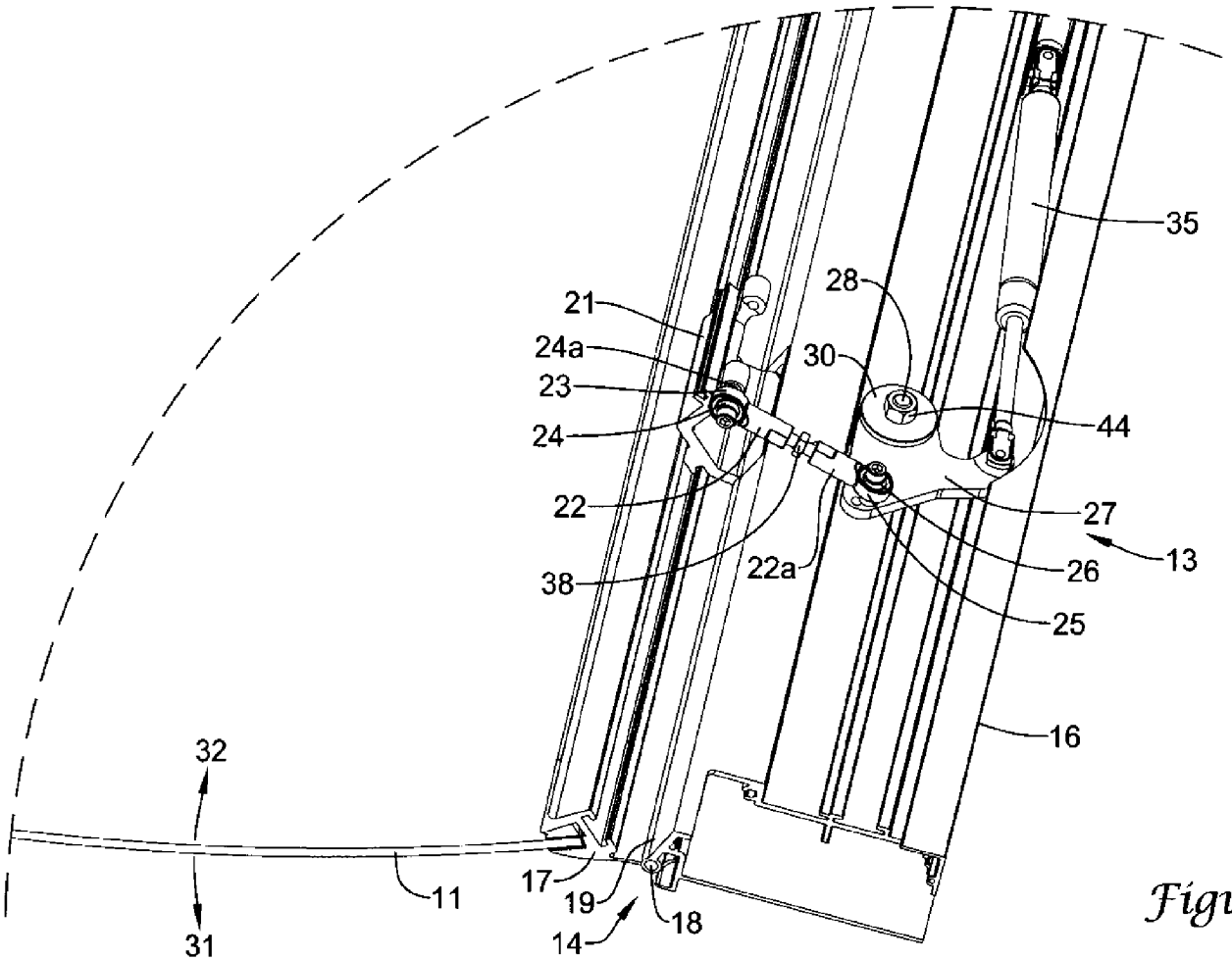
FIG. 8 shows another position of moving components of the pivot assist mechanism.
Figure 9:
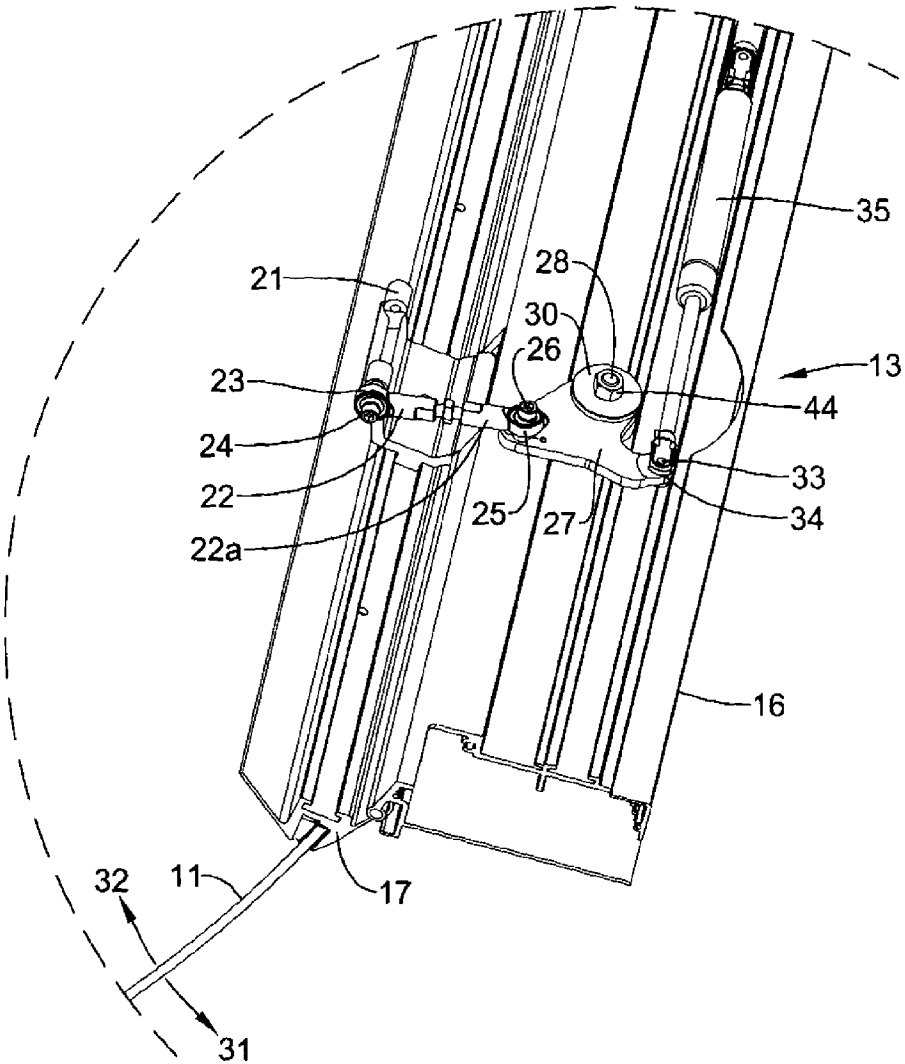
FIG. 9 shows still another position of movement of the moving components of the pivot assist mechanism.

FIG. 6 shows door 11 somewhat in a closed position. FIG. 7 shows further movement of the spring 35, end 34, bellcrank 27, link 22, link 22A, lever 21 and door 11 towards the open position. FIG. 8 shows another step of movement of spring 35, bellcrank 27, link 22, link 22A, lever 21 and door 11 towards the open position. FIG. 9 shows still another step of movement of the spring 35, bellcrank 27, link 22, link 22A, lever 21 and door 11 towards the open position of the door.

FIG. 10 shows the arrangement of the door 11 lift system where the whole gas spring or energy accumulator 35 is revealed, including the end 36 which may be connected to a protrusion or mount 37 attached to base 16 with either a fastener 41 as indicated other places herein (FIG. 4) or a secondary mount 37A and adjustment link 20. Relative to base 16, mount 37 may be moved by adjusting fastener 20 or/and sliding mount 37 relative to 37A to obtain a desired position of end 36 of gas spring 35.

Figure 11:
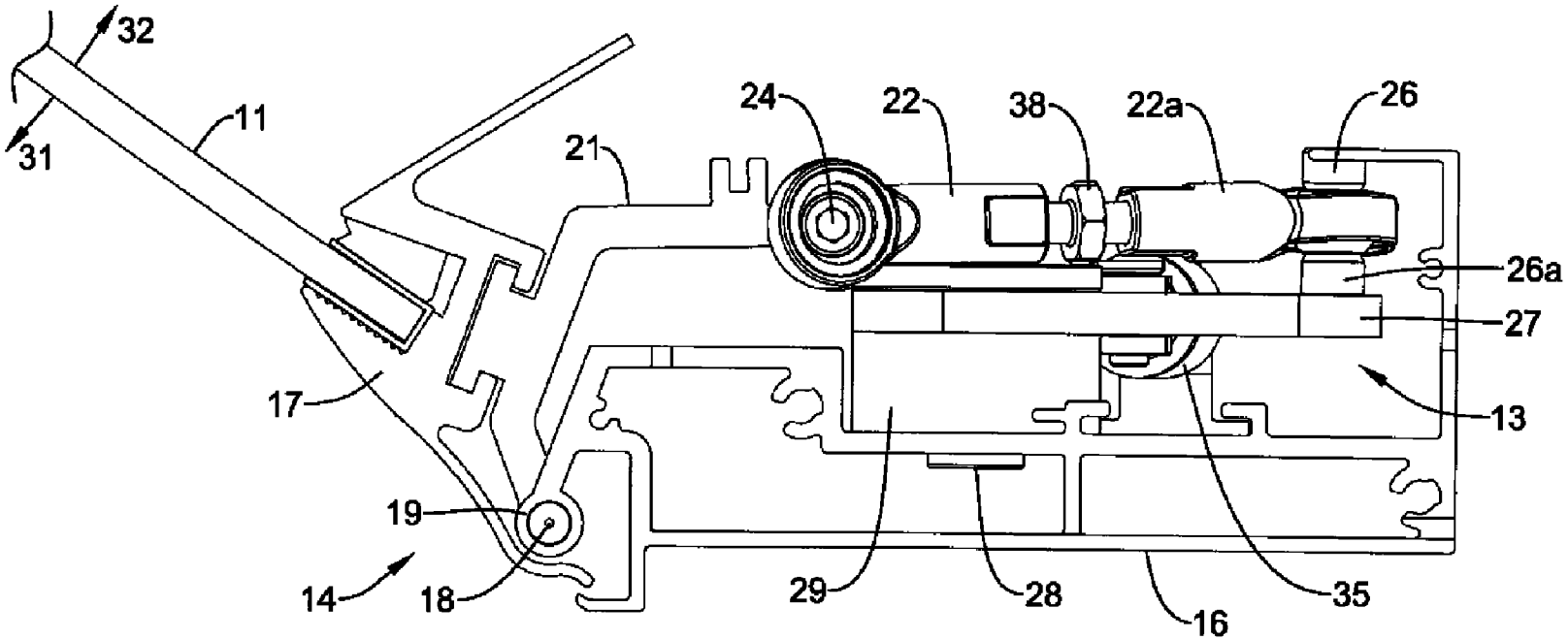
FIGS. 11, 12, 13, 14 and 15 are diagrams showing an end view of the pivot assist mechanism looking in a direction parallel to the axis of a pin of the hinge arrangement and respectively showing progressive steps of the movement of components of the mechanism with the door moving towards an open position.
Figure 12:
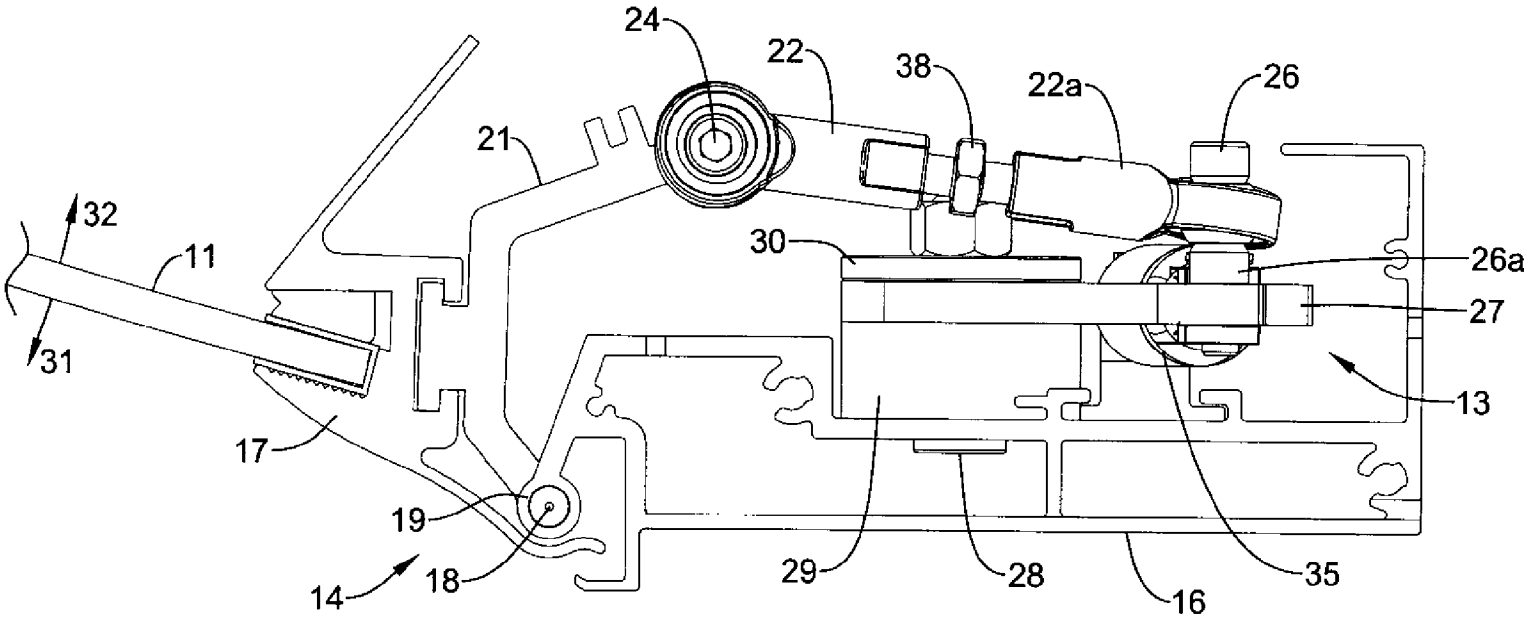
Figure 13:
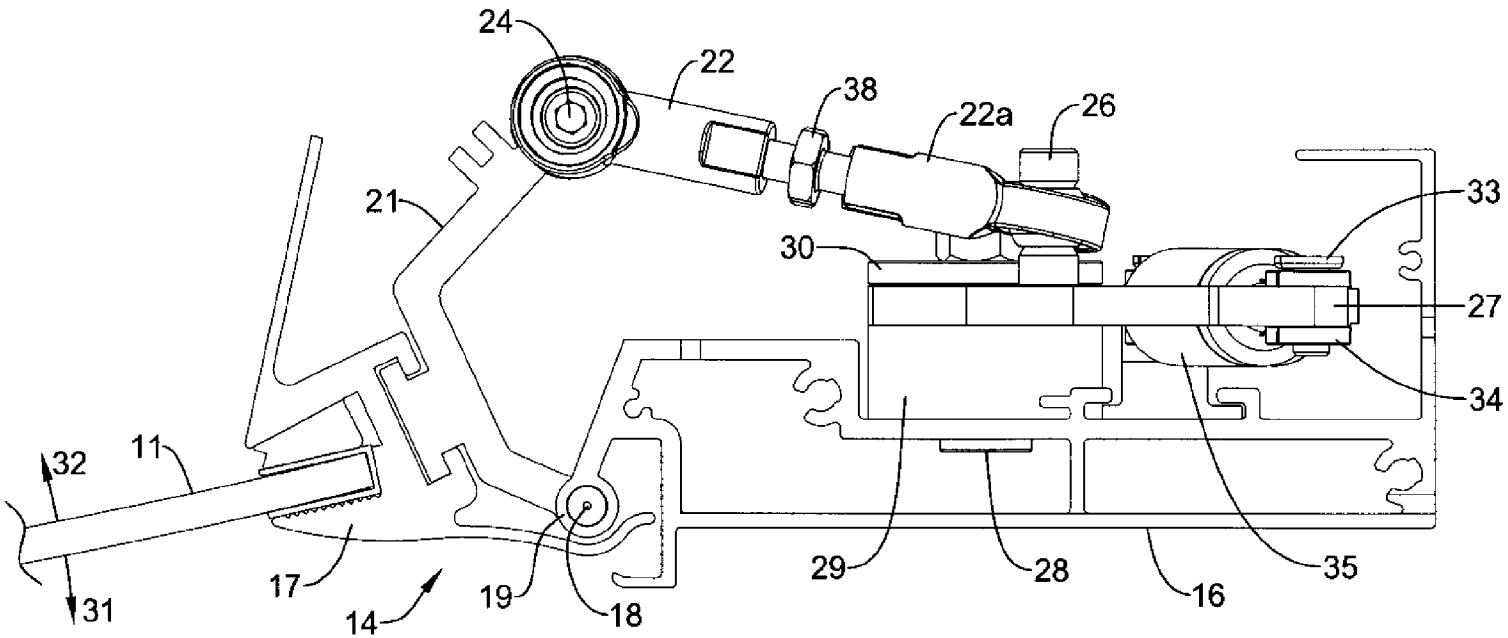
Figure 14:
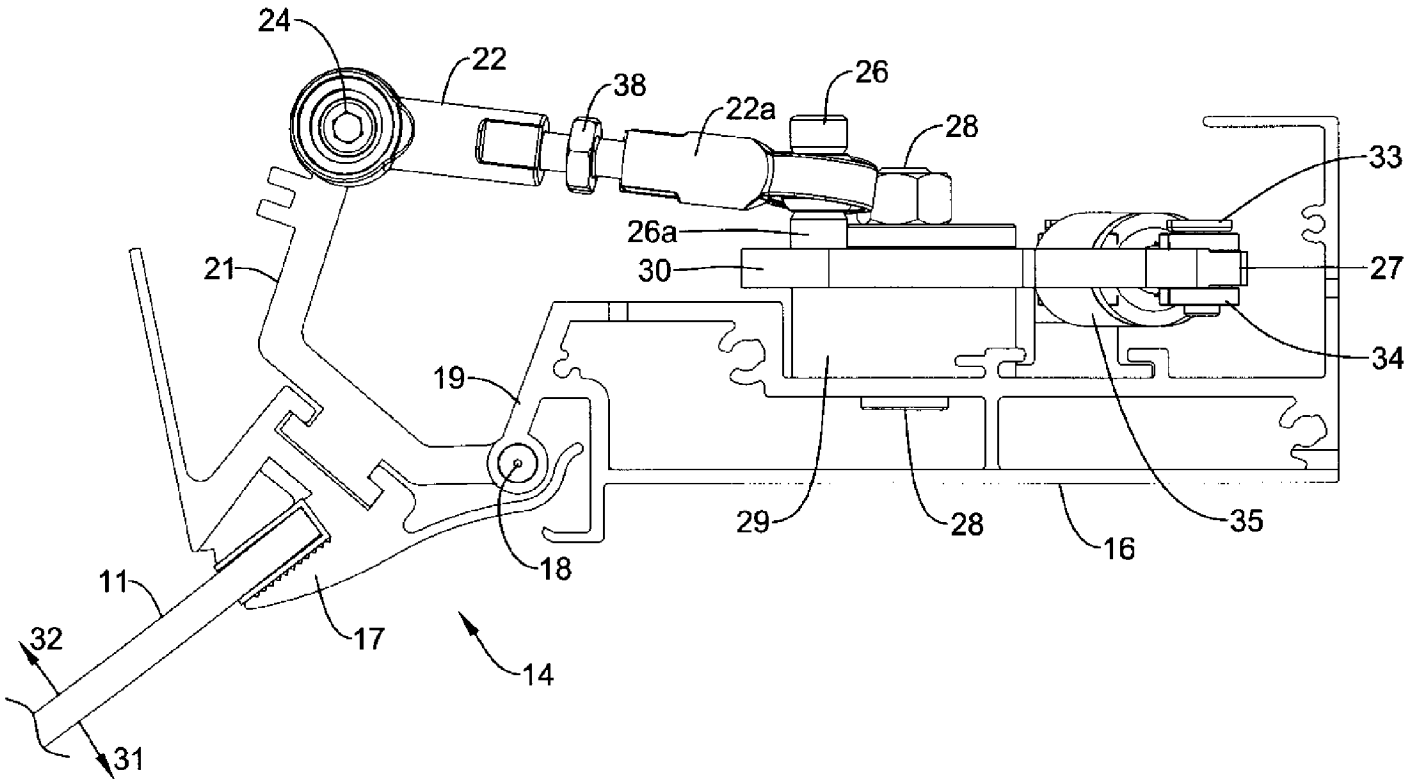
Figure 15:
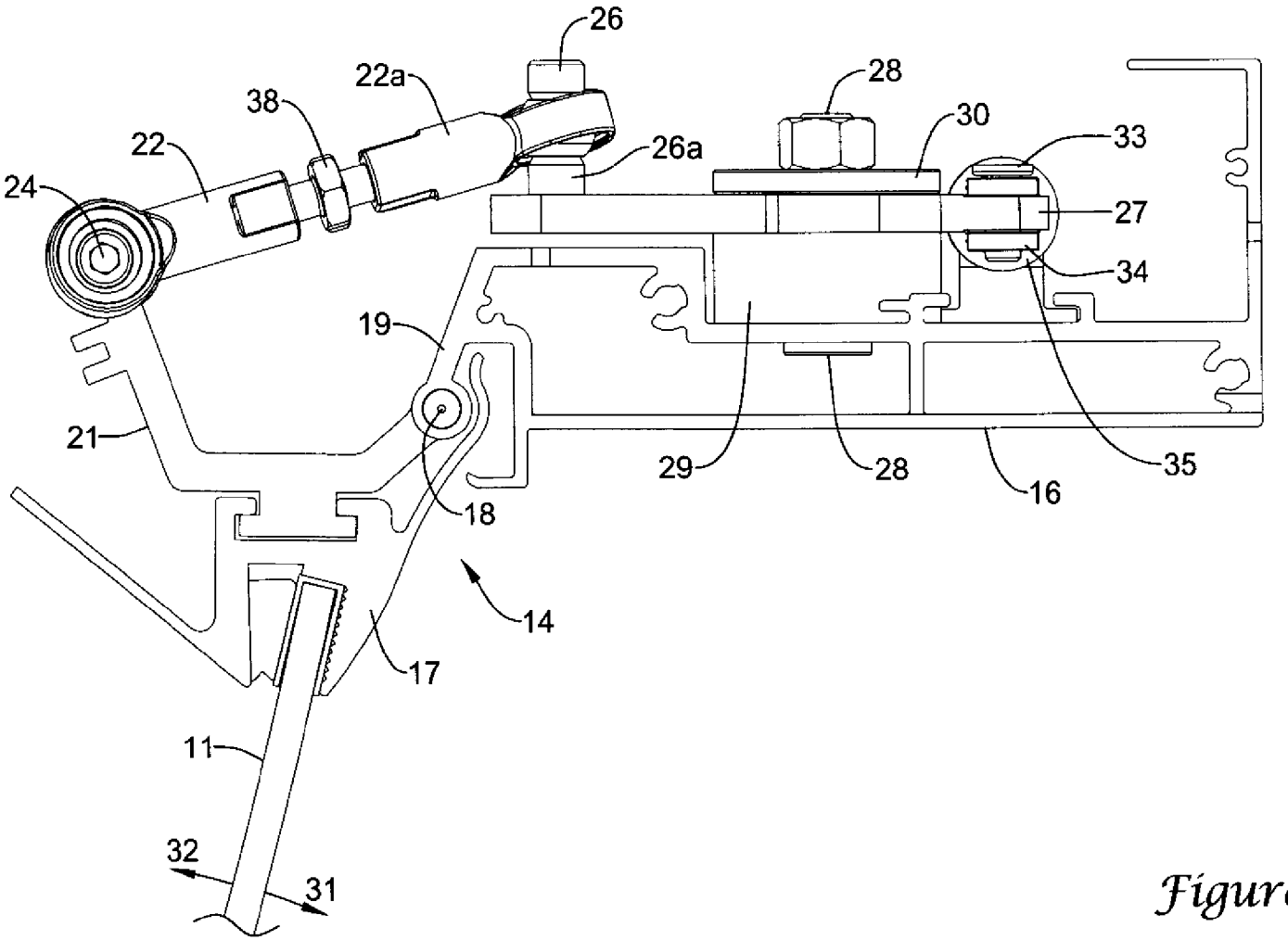

FIG. 11 is a diagram showing an end view looking in a direction parallel to the axis of pin 18 of hinge arrangement 14, and showing the positions of gas spring 35, bellcrank 27, link 22, link 22A, lever 21 and door 11. These positions appear similar to the positions of the same components shown in FIG. 6. FIG. 12 is a diagram of the end view like that of FIG. 11 but showing further movement of spring 35, bellcrank 27, link 22, link 22A, lever 21 and door 11 towards the open position. The positions of these components appear similar to those of FIG. 7. FIG. 13 is a diagram of the end view showing another step of movement of spring 35, bellcrank 27, link 22, link 22A, lever 21 and door 11 towards the open position of the door. The positions of these components appear similar to those of FIG. 8. FIG. 14 is a diagram of the end view further showing another step of movement of spring 35, bellcrank 27, link 22, link 22A, lever 21 and door 11 closer to the open position of the door. The positions of these components appear similar to those of the components in FIG. 9. FIG. 15 is a diagram of the end view showing door 11 somewhat in an open position with corresponding positions of spring 35, bellcrank 27, link 22, link 22A, lever 21 and door 11.

Figure 16:
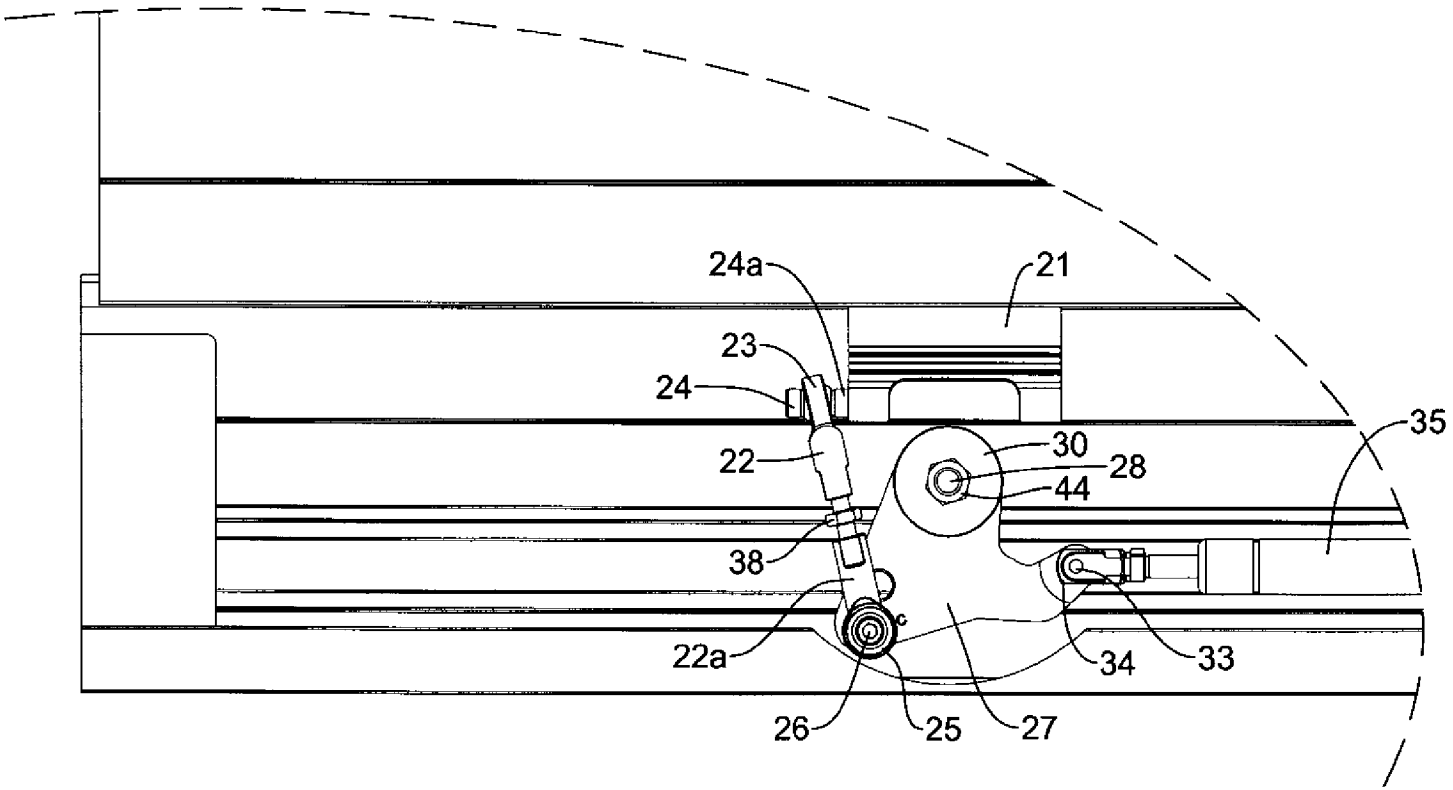
FIG. 16 is a diagram of a plan view of the components of the pivot assist mechanism for the door lift system.
Figure 17:
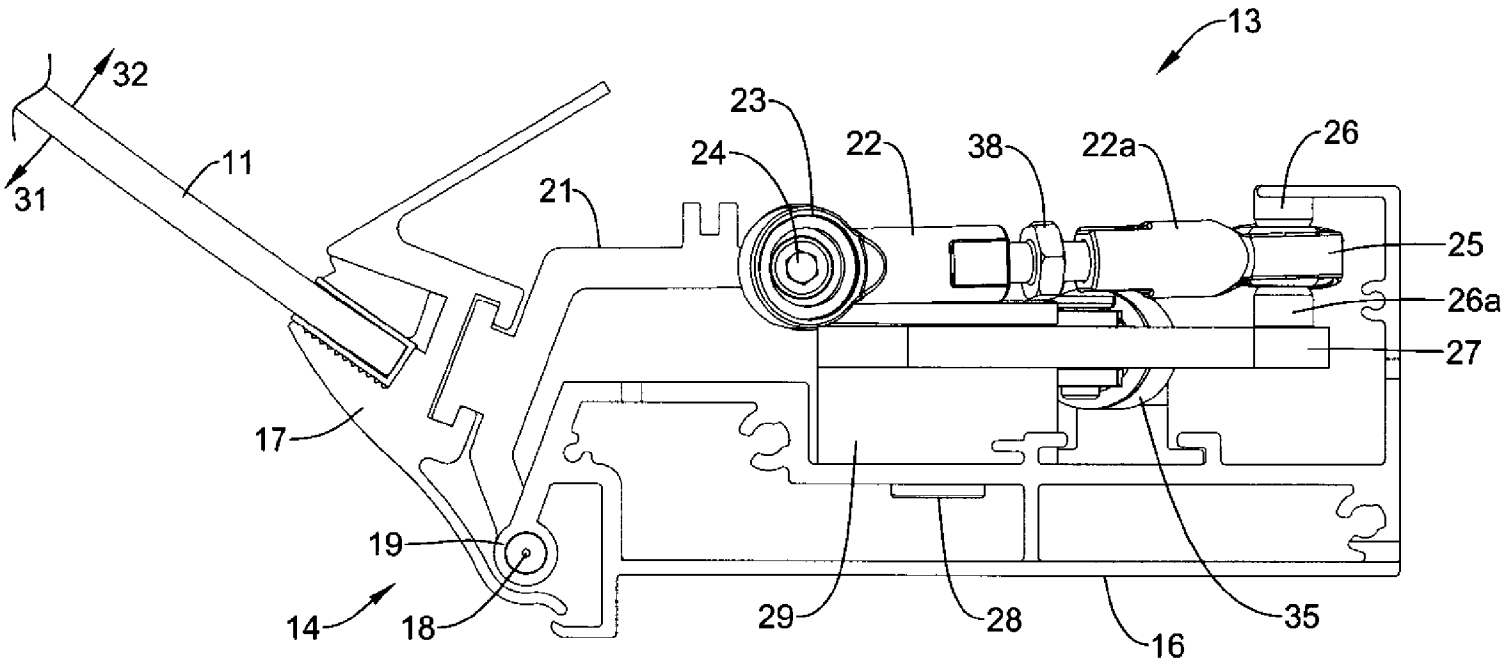
FIG. 17 is a diagram of an end view of the lift system shown in FIG. 16.

FIG. 16 is a diagram of a plan view of the components for the door 11 lift system. The components and their connections are shown with some of the mechanical detail, such as machined parts including nuts, threaded components, swivel connections of spring 35, connection 33, end 34, bellcrank plate 27, link 22, link 22A, with adjustment jack screw 38, and connector joints or sockets 23 and 25 on protrusions and balls 24, 26, stand-offs 24A and 26A (FIG. 17) of hinge lever 21 and bellcrank 27, respectively. Bellcrank plate 27 may be secured to base 16 of hinge arrangement 14 with a mount and bolt 28 and nut 44 but yet permitting plate 27 to be rotatable about an axis of bellcrank bearing 29 (FIG. 17), bellcrank washer 30, bolt 28 and nut 44. The positions of the components in FIG. 16 appear to be the same as the positions of similar components in FIG. 6. The position of door 11 in FIG. 16 appears to be in a somewhat closed position. FIG. 17 is a diagram of an end view of the lift system shown in FIG. 16. The details of the fabrication and machined aspects of the components are shown from a perspective different from that of FIG. 16. The view has a direction appearing parallel to the axis of pin 18 of the hinge arrangement 14. The positions of the components also appear to be the same as those as shown in FIG. 11. The design and arrangement are shown of the components such as spring 35 and its fastener or connection 33. Also included are bellcrank plate 27 with its mount bellcrank bearing 29, bolt 28, a connection for protrusion or ball 26, ball link stand-off 26A, for connection of socket 25 or other connection mechanism of link 22A. Also, there is link 22 with its length adjustment nut 38, the hinge lever 21 and its protrusion or ball 24 and stand-off 24A for connection of a socket 23 or other connection mechanism of link 22. The hinge arrangement 14 for door 11 and base 16 may have a variety of designs and layouts with, for an illustrative example, where one or more of the present components may be replaced with one or more other kinds of components. The present layout with the components as indicated herein may be regarded as an illustrative instance of system 13.

Figure 18:
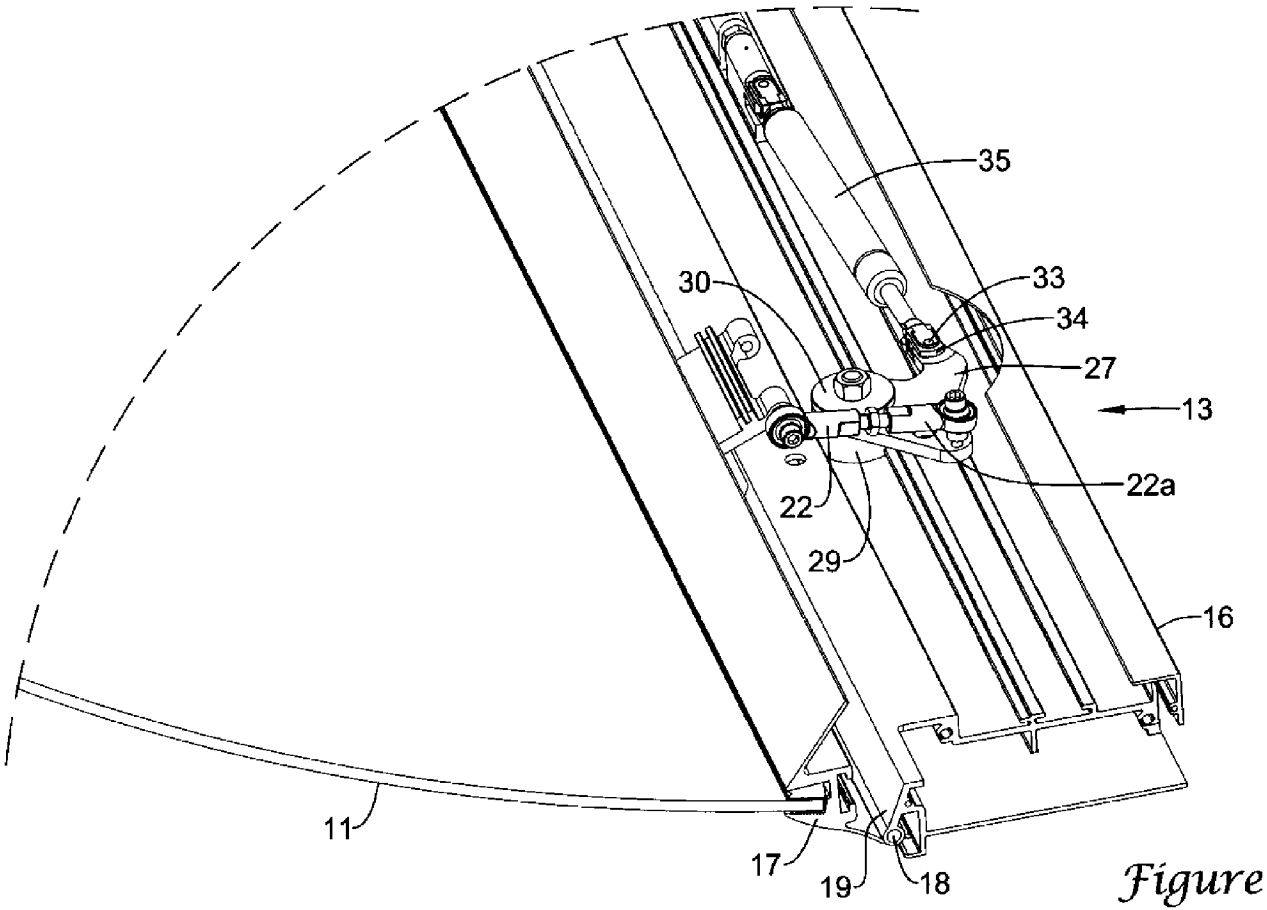
FIG. 18 is a perspective of the components from the left side when looking at the base of the hinge arrangement.
Figure 19:
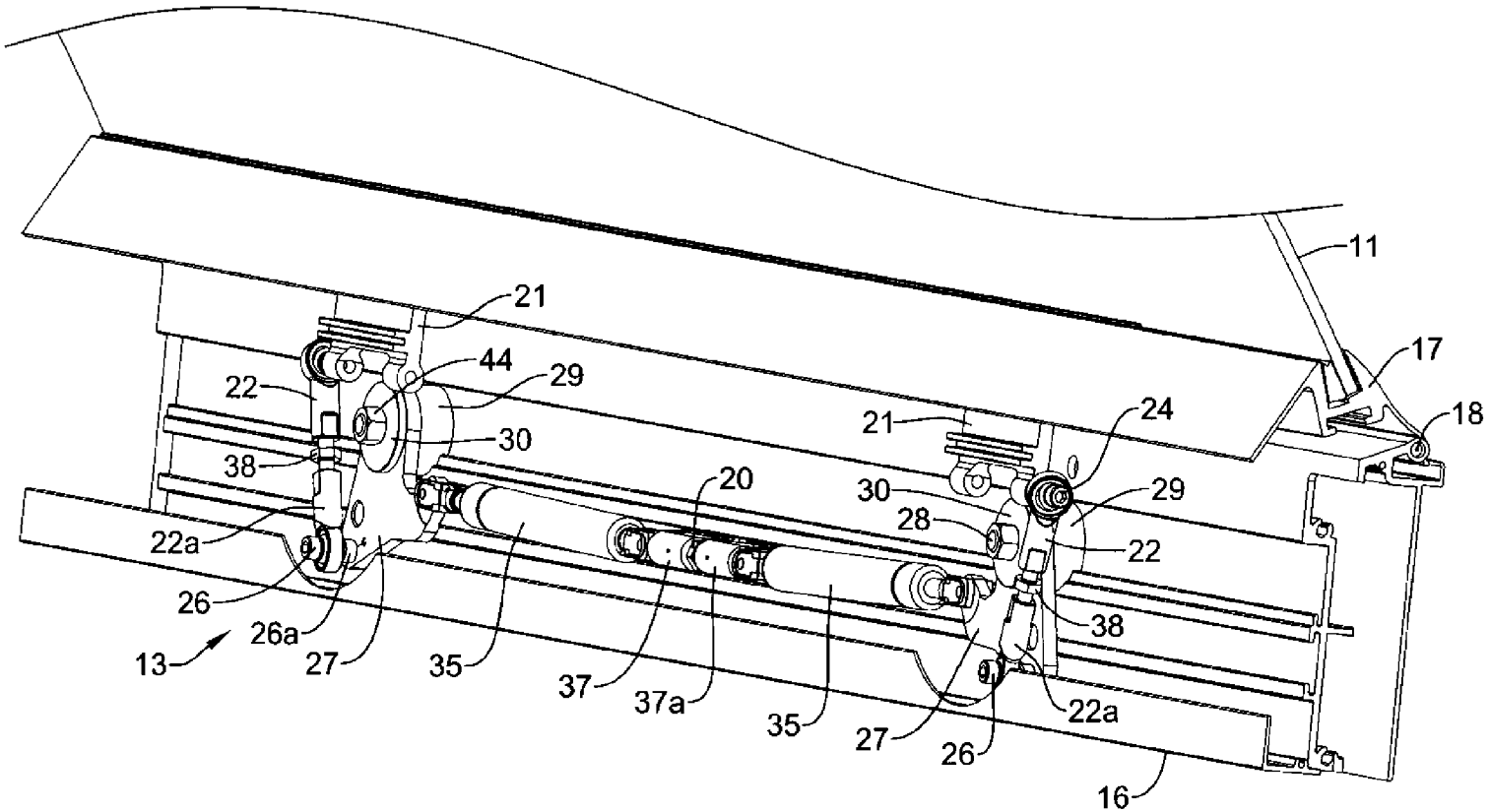
FIG. 19 is a perspective of the components from the right side when looking at the base of the hinge arrangement.
Figure 20:
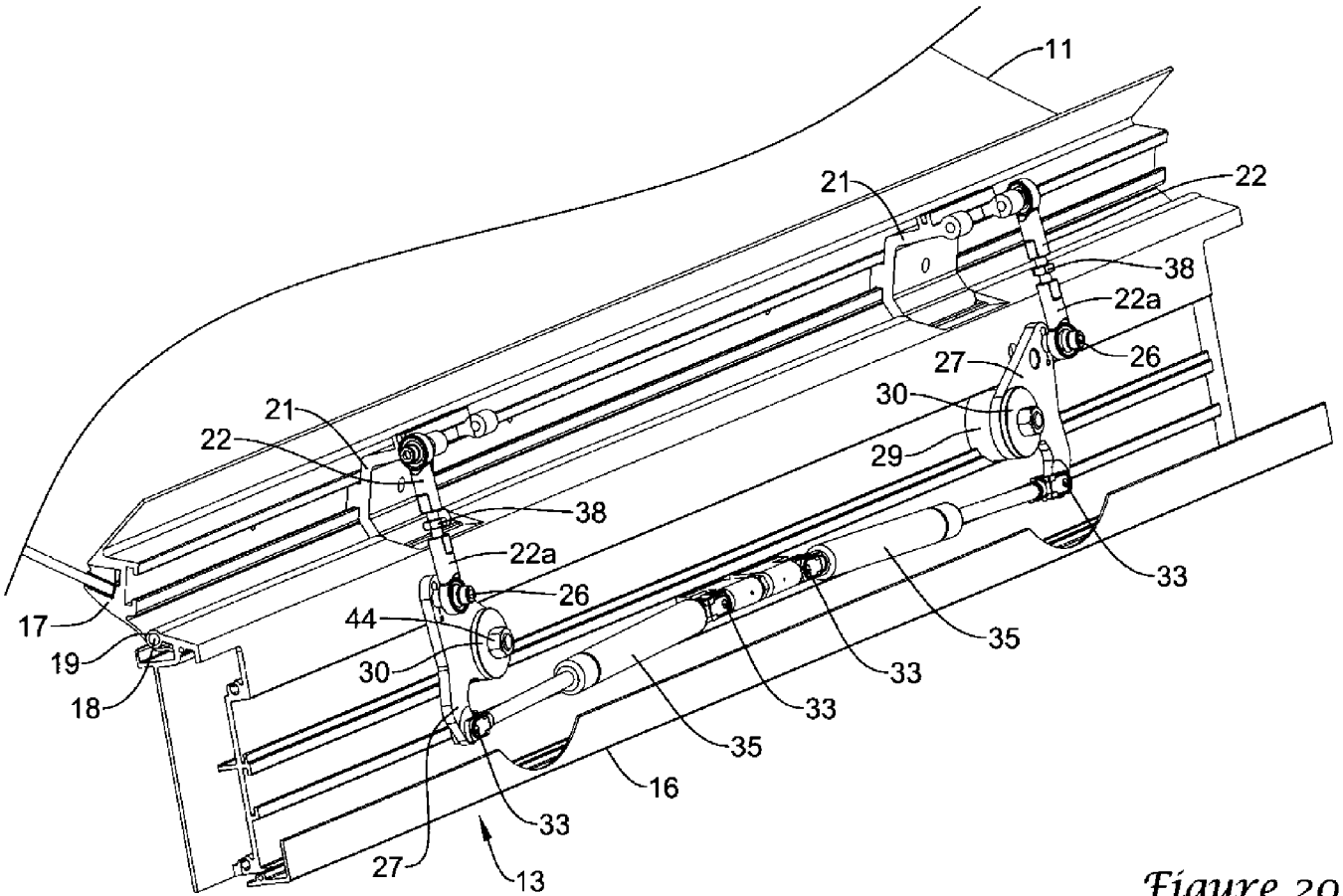
FIG. 20 is a perspective diagram of the components from the left side when looking at base.
Figure 21:
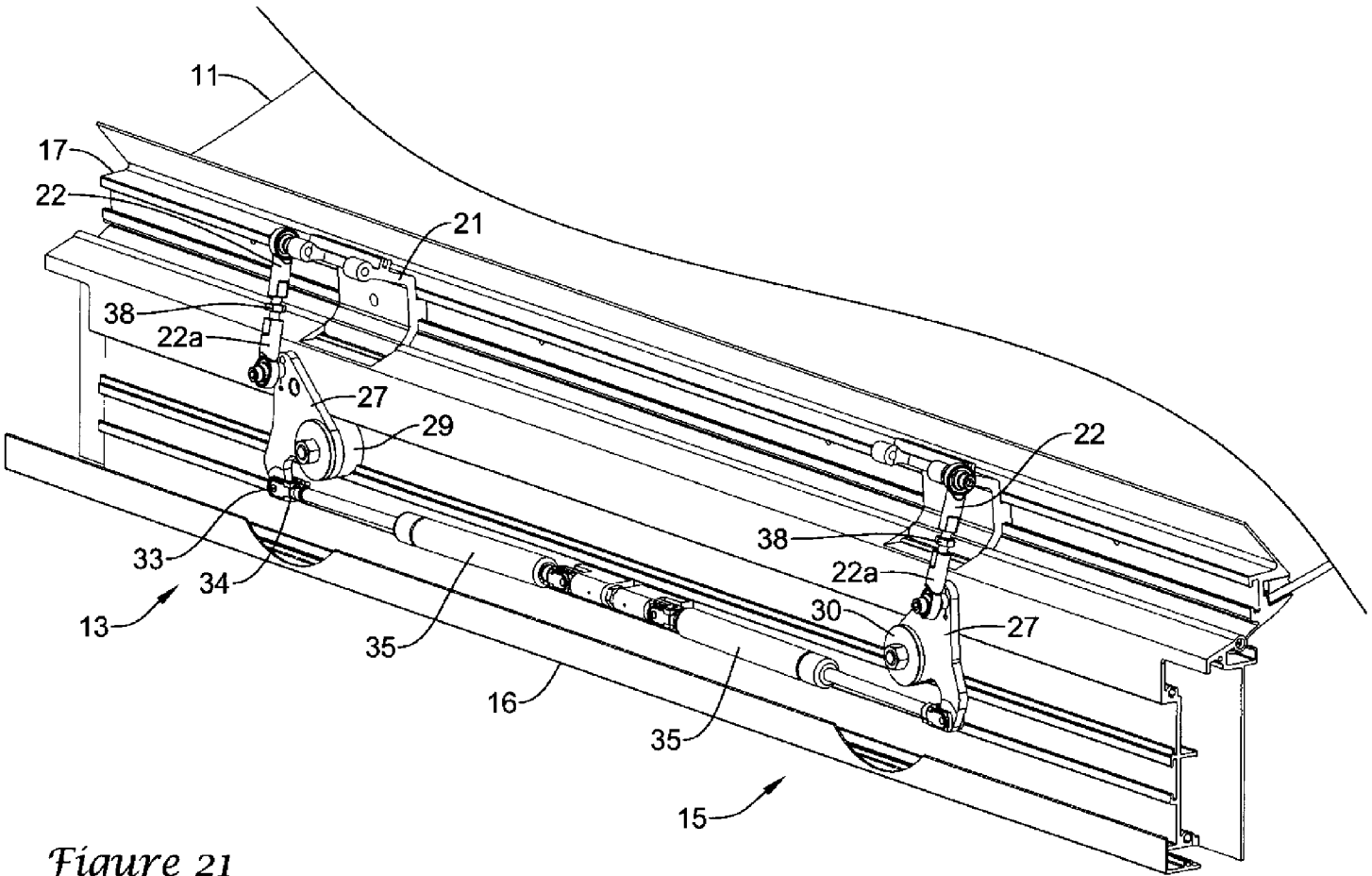
FIG. 21 is a perspective diagram of the components from the right side when looking at base.

FIGS. 18, 19, 20 and 21 are diagrams showing perspective views of the lift system arrangement 13 shown in the plan and end views of the diagrams in FIGS. 16 and 17, respectively. These diagrams further illustrate the mechanical detail of the components and their connections of the door 11 lift system 13. The positions of the components in FIGS. 18 and 19 appear to be in a place for door 11 being substantially closed. FIG. 18 is a perspective of the components from the left side when looking at mechanism 13 on base 16. FIG. 19 is a perspective of the components from the right side when looking at mechanism 13 on base 16. The positions of the components in FIGS. 20 and 21 appear to be in place for door 11 being substantially open. FIG. 20 is a perspective of the components from the left side when looking at mechanism 13 on base 16. FIG. 21 is a perspective of the components from the right side when looking at mechanism 13 on base 16.

Figure 22:
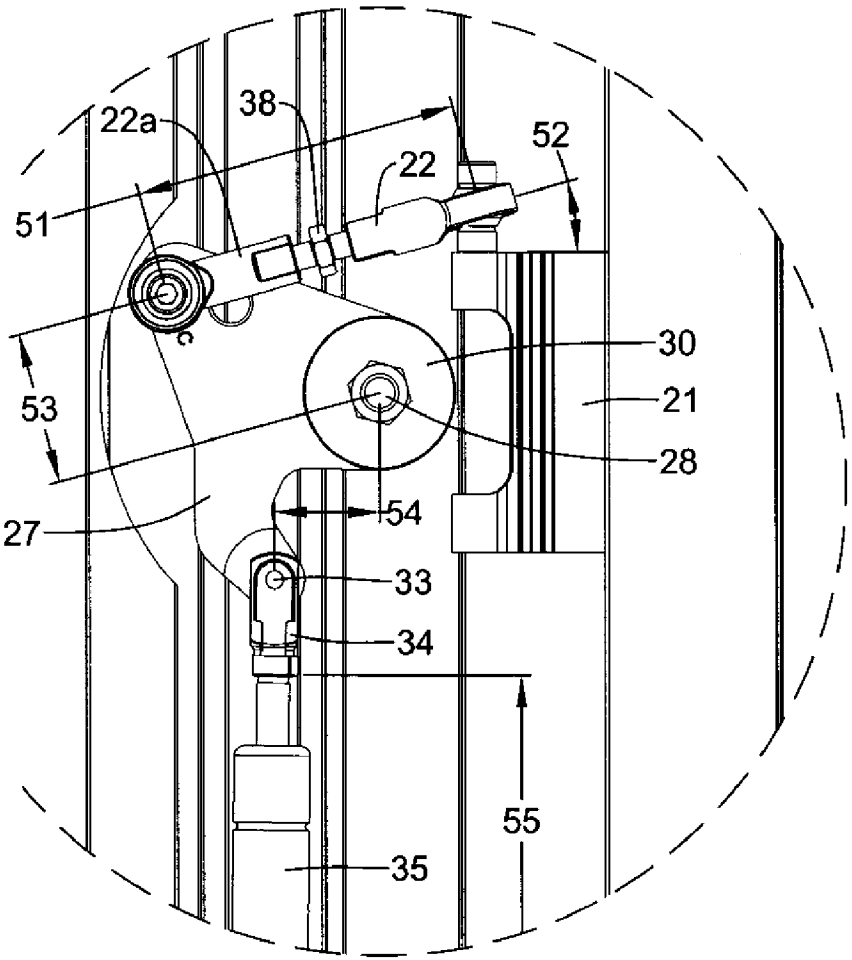
FIGS. 22, 23 and 24 are diagrams showing respectively the effect on the gas spring due varying a length dimension of a force transfer link.
Figure 23:
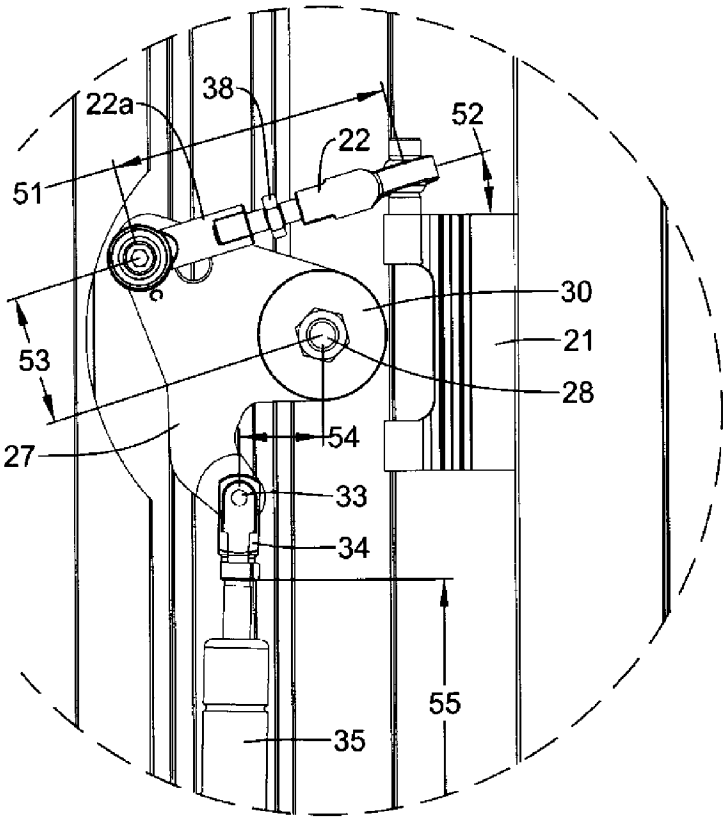
Figure 24:
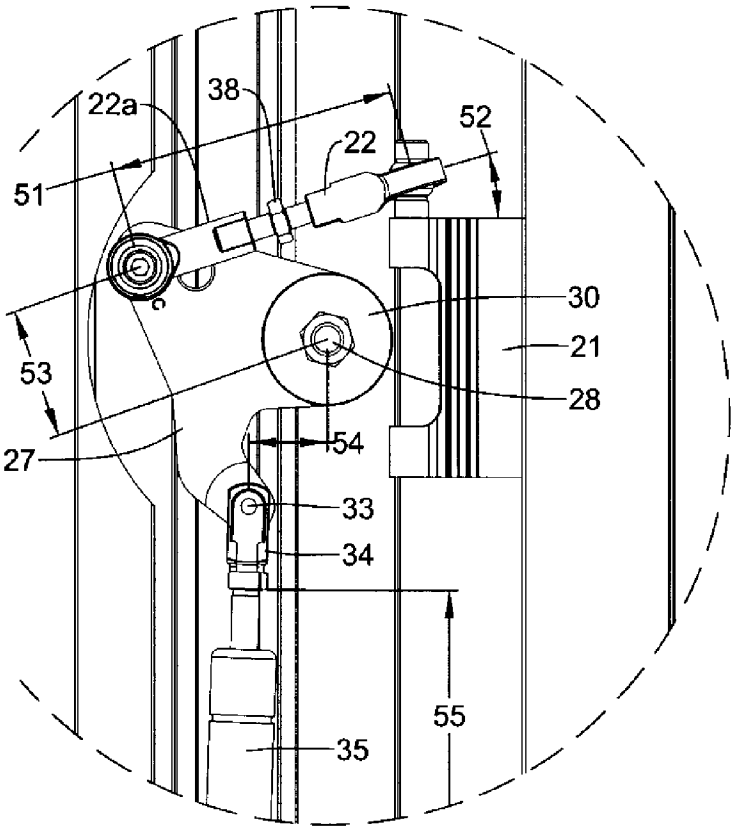

FIGS. 22, 23 and 24 together show the effect of varying a length dimension 51 of link 22 and link 22A. The length dimension 51 is shown to be a certain length in FIG. 22, for a given position of door 11 which may be regarded as being effectively in a closed position. This position may be assumed for the link 22/22A settings and measurements in FIGS. 22, 23 and 24. In other words, lever 21 may stay in the same position while the length of link 22/22A is varied. Link 22/22A may be varied on both sides. An angle 52 between link 22/22A and a line perpendicular to the axis of hinge pin 18 and in a plane parallel to base 16 may be measured. A distance 53 parallel to and between link 22/22A and the center of bolt or support 28 for bellcrank 27 may be measured. A distance 54 perpendicular to the axis of pin 18 (i.e., a hinge pivot) may be measured between the center of bolt 28 for holding bellcrank 27 and the center of connection 33 of gas spring 35 to bellcrank 27. A distance 55 may be measured of the length of gas spring 35. The length settings 51 for the door lift system in FIGS. 22, 23 and 24, may be 3.124, 3.174 and 3.224 inches, respectively. The corresponding link angles 52 may be 16.2, 17.30 and 18.4 degrees, respectively. The corresponding link distances 53 may be 1.512, 1.486 and 1.460 inches, respectively. The corresponding gas spring distances 54 may be 1.023, 0.948 and 0.870 inches; and the corresponding gas spring lengths 55 may be 6.645, 6.612 and 6.581 inches, respectively. These data are shown in a table 59 of FIG. 25. Differences or deltas between the data from the first and second length 51 settings and between the second and third settings are shown. Also, the bottom row shows an absolute delta value of the deltas.

Figure 26:
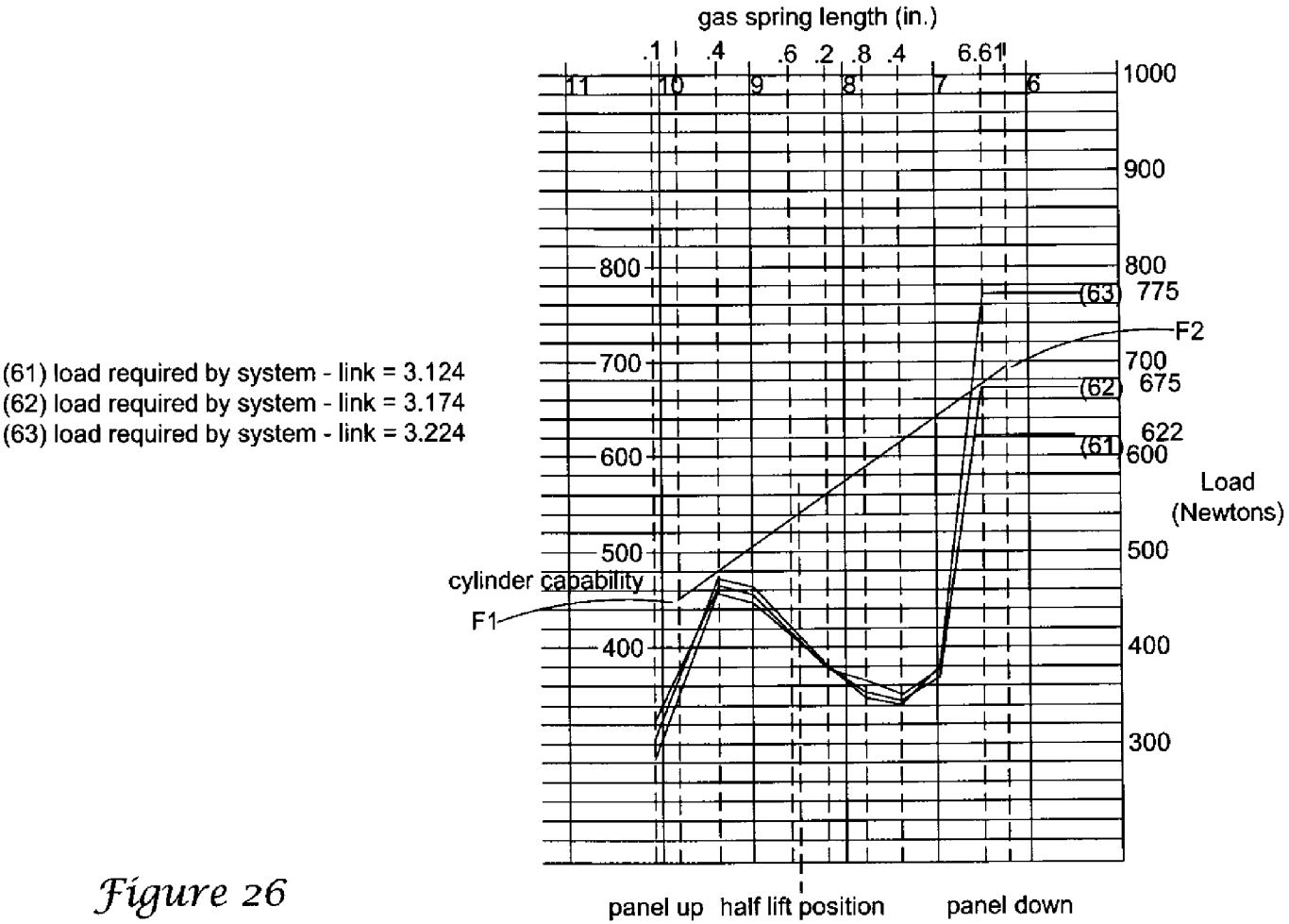
FIG. 26 shows a graph having a plot of various data due to the load required by a door lift system for various bellcrank or force transfer link length settings.

A graph 60 in FIG. 26 is a plot of various data due to the load required by the door lift system for bellcrank link or force transfer link 22 length 51 settings of 3.124, 3.174 and 3.224 inches, as represented by plot lines 61, 62 and 63, respectively. The abscissa axis indicates gas spring travel. The ordinate axis indicates the load required by the lift system in Newtons. A line indicates the half lift position and a line indicates the cylinder capability in Newtons for gas spring 35 in terms of travel. The graph shows the change in load requirements with small changes in the length of bellcrank or force transfer link 22/link 22A. This approach may be used for adjusting the closing force of the panel or door 11, without requiring several size increments of gas springs 35 at hand, whether in length and/or force.

For gas spring 35 travel of about 6.6 inches at the left of the graph in FIG. 26, the load required by system 13 for link 22 lengths 61, 62 and 63 of 3.124, 3.174 and 3.224 inches may be about 622, 675 and 775 Newtons, respectively. For gas spring travel of about 7.0 inches, the load required for link 22/22A load paths 61, 62 and 63 may be about 370, 379 and 380 Newtons, respectively. For gas spring travel at the half lift position, the load required for load paths 61, 62 and 63 may be 408, 409 and 415 Newtons, respectively. For gas spring travel at about 9.4 inches, the load required for load paths 61, 62 and 63 may be about 450, 459 and 465 Newtons, respectively. For gas spring travel at about 10.1 inches, the load required for load paths 61, 62 and 63 may be about 281, 307 and 322 Newtons, respectively. The plots for load paths 61, 62 and 63, decline linearly from the loads 622, 675 and 775 Newtons at gas spring travel distance 6.6 inches, respectively, to 370, 379 and 380 Newtons, at gas spring travel distance 7.0 inches. The plots for load paths 61, 62 and 63, rise linearly from the loads at travel distance 8.2 inches to 450, 459 and 465 Newtons, respectively, at 9.0 inches of gas spring travel. The plots for load paths 61, 62 and 63 decline linearly from the loads at travel distance 9.4 inches to 281, 307 and 322 Newtons, respectively, at travel distance 10.1 inches. Gas spring cylinder 35 capability is shown to change linearly as indicated by a plot or line from F2 (700 Newtons) at gas spring travel distance 6.1 inches to F1 (450 Newtons) at travel distance 10.1 inches.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. A lift system for a panel on a structure for an enclosure for merchandising, comprising:

a structure for one or more of a temperature-controlled enclosure and a display for merchandising;

a hinge mechanism attached to the structure;

a panel attached to the hinge mechanism and moveable about an axis of the hinge mechanism relative to the structure, and being subject to a force of gravity biasing the panel toward a first position relative to the structure; and a lift mechanism attached to the structure and the panel for providing a force on the panel causing the panel to be biased toward a second position relative to the structure; and wherein the lift mechanism comprises:

a first gas spring having a first end and having a second end;

a bellcrank mechanism mounted on the structure and rotatable about an axis, and having a first connection point at a first distance from the axis and attached to the second end of the gas spring and having a second connection point at a second distance from the axis;

a force transfer link having a first end attached to the second connection point of the bellcrank mechanism, and having a second end connected to a third connection point on the panel;

a length of the force transfer link is adjustable;

movement of the second end of the gas spring relative to the structure results in movement of the panel relative to the structure; and movement of one or more ends of the gas spring is two-dimensional.

2. The system of claim 1, wherein a change of length of the force transfer link for a given force at the second end of a gas spring results in a change of force of the force transfer link at the second end of the force transfer link and the third connection point of the panel as the panel approaches the first position.

3. The system of claim 1, wherein:

adjusting the length of a force transfer link changes a differential ratio of mechanical advantage from a first ratio to a second ratio in that a differential ratio of mechanical advantage is a ratio of a change in a force transfer link length versus a change in a gas spring load for a given load at the second end of the force transfer link to lift a load of the panel; and the second ratio is greater that the first ratio.

4. The system of claim 1, wherein the first end of the gas spring is adjustable in position relative to the structure.

5. The system of claim 1, wherein the force transfer link can be coupled at different locations of a second connection region of a bellcrank mechanism to provide an optimized force geometry to accommodate various panel conditions.

6. The system of claim 5, wherein the optimized force geometry provides for an optimized force required to close the panel.

7. The system of claim 1, wherein:

the bellcrank mechanism has a hole;

a base of the enclosure has a hole; and the holes may be aligned and a pin put in the holes to lock the bellcrank mechanism in position.

8. The system of claim 1, wherein the lift mechanism further comprises:

a second gas spring having a first end attached to the first end of the first gas spring and having a second end;

a second bellcrank mechanism mounted on the structure and rotatable about a second axis, and having a third connection point at a third distance from the second axis and attached to the second end of the second gas spring and having a fourth connection point at a fourth connection point at a fourth distance from the axis;

a second force transfer link having a first end attached to the third connection point of the second bellcrank mechanism, and having a second end to a connected to a fifth connection point on the panel;

movement of the second end of the second gas spring relative to the structure results in movement of the panel relative to the structure; and movement of one or more ends of the second gas spring is two-dimensional.

9. The system of claim 8, wherein:

a length of the second force transfer link is adjustable; and a change of length of the second force transfer link for a given force at the second end of the second gas spring results in a change of force of the second force transfer link at the second end of the second force transfer link and the fifth connection point on the panel.

10. The system of claim 8, wherein:

adjusting a length of the second force transfer link changes a differential ratio of mechanical advantage in that a change of a first measure yields a change of a second measure in a second gas spring load for a given load at the second end of the second force transfer link; and the change of the second measure is greater than the change of the first measure.

11. The system of claim 8, wherein one or more of the force transfer links can be coupled at different locations of a second connection region of one or more of the bellcrank mechanisms to provide an optimized force geometry to accommodate various panel conditions.

12. The system of claim 8, wherein:

one or more of the bellcrank mechanisms have a hole;

a base of the enclosure has one or more holes; and one or more of the one or more holes in the bellcrank mechanisms and one or more of the one or more holes in the base of the enclosure may be aligned and a pin put in the aligned holes to lock the one or more bellcrank mechanisms in a position.

13. The system of claim 8, wherein:

the first end of the first gas spring is adjustable in position relative to the structure; and the first end of the second gas spring is adjustable in position relative to the structure.

14. The system of claim 8, wherein:

the first end of the gas spring and the first end of the second gas spring are connected to each other and are moveable relative to the structure; and the first end of the gas spring and the first end of the second gas spring are adjustable in position relative to each other.

15. The system of claim 8, wherein the lift mechanism further comprises:

a third gas spring having a first end attached to the structure and having a second end;

a third bellcrank mechanism mounted on the structure and rotatable about a second axis, and having a third connection point at a third distance from the second axis and attached to the second end of the third gas spring and having a fourth connection point at a fourth connection point at a fourth distance from the axis;

a third force transfer link having a first end attached to the third connection point of the third bellcrank mechanism, and having a second end to a connected to a fifth connection point on a second panel;

movement of the second end of the third gas spring relative to the structure results in movement of the second panel relative to the structure; and movement of one or more ends of the third gas spring is two-dimensional.

16. A pivot assist mechanism for providing a pivot assist to a panel of a merchandising enclosure, where the panel pivots about a hinge, the pivot assist mechanism comprising:

a first energy accumulator having a first end and a second end, wherein the first energy accumulator provides an outward force between the first end and the second end;

a first bellcrank mechanism mounted relative to the merchandising enclosure and having an axis of rotation, the first bellcrank mechanism having a first connection region spaced a first distance from an axis of rotation of the first bellcrank mechanism, the first connection region of the first bellcrank mechanism is connected to the second end of the first energy accumulator, the first bellcrank mechanism further having a second connection region spaced a second distance from the axis of rotation of the first bellcrank mechanism; and a first force transfer element coupled between the second connection region of the first bellcrank mechanism and the hinge for providing a pivot assist to the door through the hinge, the first force transfer element having an adjustment mechanism for adjusting a length of the first force transfer element; and a second energy accumulator having a first end and a second end, wherein the second energy accumulator provides an outward force between the first end and the second end, and wherein the first end of the second energy accumulator is secured to the first end of the first energy accumulator;

a second bellcrank mechanism mounted relative to the merchandising enclosure and having an axis of rotation, the second bellcrank mechanism having a first connection region spaced a first distance from the axis of rotation of the second bellcrank mechanism, the first connection region of the second bellcrank mechanism being connected to the second end of the second energy accumulator, the second bellcrank mechanism further having a second connection region spaced a second distance from the axis of rotation of the second bellcrank mechanism; and a second force transfer element coupled between the second connection region of the second bellcrank mechanism and a second hinge for providing a pivot assist to the door through the second hinge, the second force transfer element having an adjustment mechanism for adjusting a length of the second force transfer element; and wherein:

adjusting the length of the first or second force transfer element changes a differential ratio of mechanical advantage in that a change of a measurement of a length of the first or second force transfer element yields a change of a measurement of an energy accumulator load for a given load at an end of the first or second force transfer element to lift a load of the door; and the change of the measurement of an energy accumulator load change is greater than the change of the measurement of the length of the force transfer element change.

17. The pivot assist mechanism of claim 16, wherein:

one or more of the force transfer elements can be coupled at different locations at the second connection region of one or more of the bellcrank mechanisms to provide an optimized force geometry to accommodate various door conditions; and movement of one or more ends of the energy accumulators is two dimensional.

18. The pivot assist mechanism of claim 16, wherein:

the bellcrank mechanism has a hole;

a base of the enclosure has a hole; and the holes may be aligned and a pin put in the holes to lock the bellcrank mechanism in a position.

19. A pivot assist mechanism for providing a pivot assist to a door of a merchandising enclosure, where the door pivots about a first hinge and a second hinge, the pivot assist mechanism comprising:

a first gas cylinder having a first end and a second end, wherein the first gas cylinder provides an outward force between the first end and the second end;

a second gas cylinder having a first end and a second end, wherein the second gas cylinder provides an outward force between the first end and the second end;

a first bellcrank mechanism having a first axis of rotation, the first bellcrank mechanism having a first connection region spaced a first distance from the first axis of rotation and coupled to the second end of the first gas cylinder, the first bellcrank mechanism further having a second connection region spaced a second distance from the axis of rotation;

a second bellcrank mechanism having a second axis of rotation, the second bellcrank mechanism having a second connection region spaced a third distance from the second axis of rotation and coupled to the second end of the second gas cylinder, the second bellcrank mechanism further having a second connection region spaced a fourth distance from the second axis of rotation;

a first force transfer element coupled between the second connection region of the first bellcrank mechanism and the first hinge, the first force transfer element having an adjustment mechanism for adjusting a length of the first force transfer element; and a second force transfer element coupled between the second connection region of the second bellcrank mechanism and the second hinge, the second force transfer element having an adjustment mechanism for adjusting a length of the second force transfer element.

20. The mechanism of claim 19, wherein:

adjusting the length of the first or second force transfer element changes a differential ratio of mechanical advantage in that a change in a measurement of the length of the first or second force transfer element yields a change in a measurement of a gas cylinder load for a given load at an end of the first or second force transfer element to lift a load of the door;

the change in the measurement of the gas cylinder load is greater than the change in the length of the first or second force transfer element; and a force transfer element can be coupled at different locations of the second connection region of a bellcrank mechanism to provide an optimized force geometry to accommodate various door conditions.

* * * * *